US008115587B2

(12) United States Patent
Koto et al.

(10) Patent No.: US 8,115,587 B2
(45) Date of Patent: Feb. 14, 2012

(54) NTC THERMISTOR CERAMIC, METHOD FOR PRODUCING NTC THERMISTOR CERAMIC, AND NTC THERMISTOR

(75) Inventors: Kiyohiro Koto, Higashiohmi (JP); Makoto Kumatoriya, Otsu (JP)

(73) Assignee: Murata Manufacturing Co., Ltd., Nagaokakyo-Shi, Kyoto-fu (JP)

( * ) Notice: Subject to any disclaimer, the term of this patent is extended or adjusted under 35 U.S.C. 154(b) by 0 days.

(21) Appl. No.: 12/891,908

(22) Filed: Sep. 28, 2010

(65) Prior Publication Data

US 2011/0012707 A1 Jan. 20, 2011

Related U.S. Application Data

(63) Continuation of application No. PCT/JP2009/055989, filed on Mar. 25, 2009.

(30) Foreign Application Priority Data

Mar. 28, 2008 (JP) ..... 2008-086480

(51) Int. Cl.
*H01C 7/10* (2006.01)

(52) U.S. Cl. ..... 338/22 R; 338/332; 338/324; 29/610.1; 428/698; 252/518.1

(58) Field of Classification Search ..... 338/22 R, 338/25, 225, 262, 324, 332; 29/610.1, 619; 428/698; 252/518.1, 519
See application file for complete search history.

(56) References Cited

U.S. PATENT DOCUMENTS 6,063,311 A 5/2000 Takeuchi et al.
6,143,432 A * 11/2000 de Rochemont et al. ..... 428/689
6,553,646 B1 * 4/2003 de Rochemont ..... 29/599
7,338,582 B2 3/2008 Suzuki et al.
2005/0031704 A1 2/2005 Ahn
2006/0018821 A1 1/2006 Suzuki et al.
2008/0048821 A1 2/2008 Miura et al.

(Continued)

FOREIGN PATENT DOCUMENTS

JP 58-012304 A 1/1983

(Continued)

OTHER PUBLICATIONS

Couderc et al., "Domain Microstructure in Hausmannite Mn304 and in Nickel Manganite" Third Euro-Ceramics, vol. 1, pp. 763-768 (1993).

*Primary Examiner* — Kyung Lee
(74) *Attorney, Agent, or Firm* — Dickstein Shapiro LLP

(57) ABSTRACT

A ceramic main body 1 is composed of a $(Mn,Ni)_3O_4$- or $(Mn,Co)_3O_4$-based ceramic material. A first phase has a spinel structure. A second phase is formed of high-resistance plate crystals. The second phase is present in the first phase in a dispersed state. A heated pathway having a predetermined pattern is formed on a surface of the ceramic main body by the application of heat by laser irradiation. In the heated pathway, the second phase disappears and is crystallographically equivalent to the first phase. The plate crystals of the second phase precipitate at 800° C. or lower in the cooling substep during firing. The formation of the heated pathway facilitates the adjustment of the resistance of an NTC thermistor. Thereby, provided are an NTC thermistor ceramic with a resistance that can be easily adjusted to a lower value even after sintering, a method for producing the NTC thermistor ceramic, and an NTC thermistor.

18 Claims, 13 Drawing Sheets

U.S. PATENT DOCUMENTS

| | | | |
|---|---|---|---|
| 2008/0216306 | A1 | 9/2008 | Fujimoto |
| 2009/0179732 | A1 | 7/2009 | Koto |

FOREIGN PATENT DOCUMENTS

| | | | |
|---|---|---|---|
| JP | 59-075607 | A | 4/1984 |
| JP | 60-045001 | A | 3/1985 |
| JP | 062-011202 | A | 1/1987 |
| JP | 63126204 | A | 5/1988 |
| JP | 63315550 | A | 12/1988 |
| JP | 2-312202 | A | 12/1990 |
| JP | 4250601 | A | 9/1992 |
| JP | 6231905 | A | 8/1994 |
| JP | 11-162710 | A | 6/1999 |
| JP | 2000068110 | | 3/2000 |
| JP | 2003-257707 | A | 9/2003 |
| JP | 2004-363528 | A | 12/2004 |
| JP | 2005-150289 | A | 6/2005 |
| JP | 2007-503849 | | 3/2007 |
| JP | 2007314395 | A | 12/2007 |
| JP | 2008-226956 | A | 9/2008 |
| WO | WO-2005-019109 | A1 | 3/2005 |
| WO | WO-2006085507 | A1 | 8/2006 |
| WO | WO-2008041481 | A1 | 4/2008 |

* cited by examiner

NTC THERMISTOR CERAMIC, METHOD FOR PRODUCING NTC THERMISTOR CERAMIC, AND NTC THERMISTOR

This is a continuation of application Serial No. PVCT/JP2009/055989, filed Mar. 25, 2009, the contents of which are incorporated herein by reference.

TECHNICAL FIELD

The present invention relates to an NTC thermistor ceramic suitable as a material for an NTC thermistor having a negative resistance temperature characteristic, a method for producing the NTC thermistor ceramic, and an NTC thermistor produced with the NTC thermistor ceramic.

BACKGROUND ART

Thermistors with negative resistance temperature characteristics (NTC) have been widely used as resistors for temperature compensation and for suppressing an inrush current.

As a ceramic material used for NTC thermistors of this sort, a ceramic composition mainly containing Mn is known.

For example, Patent Document 1 discloses a thermistor composition composed of oxides containing Mn, Ni, and Al, the composition having a Mn content of 20% to 85% by mole, a Ni content of 5% to 70% by mole, and an Al content of 0.1% to 9% by mole, with the sum of these contents being 100% by mole.

Patent Document 2 discloses a thermistor composition containing metal oxides, the composition having a Mn content of 50% to 90% by mole and a Ni content of 10% to 50% by mole in terms of metal, with sum of these contents being 100% by mole, in which 0.01% to 20% by weight of $CO_3O_4$, 5% to 20% by weight of CuO, 0.01% to 20% by weight of $Fe_2O_3$, and 0.01% to 5.0% by weight of $ZrO_2$ are added to the composition.

Patent Document 3 discloses a thermistor composition containing a Mn oxide, a Ni oxide, an Fe oxide, and a Zr oxide, having "a" percent by mole (wherein $45<a<95$) of the Mn oxide in terms of Mn and (100−a) percent by mole of the Ni oxide in terms of Ni as main components, in which when the proportion of the main components is defined as 100% by weight, the proportions the other components are as follows: 0% to 55% by weight of the Fe oxide in terms of $Fe_2O_3$ (provided that 0% by weight and 55% by weight are excluded) and 0% to 15% by weight of the Zr oxide in terms of $ZrO_2$ (provided that 0% by weight and 15% by weight are excluded).

Non-Patent Document 1 reports that when $Mn_3O_4$ is gradually cooled (at a cooling rate of 6° C./hr) from a high temperature, plate crystals are formed. It also reports that when rapid cooling from a high temperature in air, although the plate crystals are not formed, a lamella structure (streak-like contrast) appears.

Furthermore, Non-Patent Document 1 reports that when $Ni_{0.75}Mn_{2.25}O_4$ is gradually cooled from a high temperature (at a cooling rate of 6° C./hr), a single spinel phase is formed, and plate-like precipitates and a lamella structure are not observed. For rapid cooling from a high temperature in air, although the plate-like precipitates are not formed, the lamella structure appears.

That is, Non-Patent Document 1 describes that for $Mn_3O_4$ and $Ni_{0.75}Mn_{2.25}O_4$, a change in the cooling rate from a high temperature results in textures having different crystal structures. In addition, Non-Patent Document 1 describes that for $Mn_3O_4$, in order to obtain plate-like precipitates, it is necessary to slow cooling from a high temperature to a cooling rate of about 6° C./hr.

[Patent Document 1] Japanese Unexamined Patent Application Publication No. 62-11202

[Patent Document 2] Japanese Patent No. 3430023

[Patent Document 3] Japanese Unexamined Patent Application Publication No. 2005-150289

[Non-Patent Document 1] J. J. Couderc, M. Brieu, S. Fritsch and A. Rousset. Domain Microstructure in Hausmannite $Mn_3O_4$ and in Nickel Manganite, Third Euro-Ceramics VOL. 1 (1993) p. 763-768.

DISCLOSURE OF INVENTION

Problems to be Solved by the Invention

When NTC thermistors are produced using the thermistor composition described in any of Patent Documents 1 to 3, if the ceramic raw material is insufficiently dispersed in the course of the production, sintered ceramic grains can be unevenly dispersed, causing variations in resistance from thermistor to thermistor. Furthermore, if the ceramic raw material has varying particle sizes, variations in resistance for each thermistor can occur.

Moreover, the resistance of a thermistor is largely dependent upon, for example, the resistivity of the ceramic material itself and the distance between internal electrodes. Thus, an approximate resistance is usually determined at a stage before sintering. Hence, it is difficult to adjust the resistance after sintering. In particular, it is difficult to adjust the resistance to a lower value.

For example, it is conceivable that a method in which the resistance is adjusted after sintering by adjusting the length of covered portions (portions extending from end faces to side faces of the ceramic body) of external electrodes formed at both end portions of a ceramic body may be employed as a method for adjusting variations in the resistance from thermistor to thermistor. For such a method, although the resistance can be fine-tuned, it is difficult to largely adjust the resistance.

Hitherto, a method has been employed in which, for example, the variations in resistance from thermistor to thermistor are adjusted by setting the resistance of a sintered ceramic body to a lower value than a target resistance value and grinding a ceramic body by laser trimming to increase the resistance.

However, recent trends toward reductions in the size and resistance of NTC thermistors have restricted the setting of the resistance of a ceramic body to a lower value than a target value. But, in order to suppress the variations in resistance from NTC thermistor to NTC thermistor, it is desired to adjust the resistance to a lower value after sintering.

Meanwhile, Non-Patent Document 1 describes that for $Mn_3O_4$, a change in cooling rate from a high temperature results in textures with different crystal structures. However, this is an insulating material and is not used for an NTC thermistor. Furthermore, the document is silent about adjustment of the resistance of an NTC thermistor. Moreover, in order to obtain the plate-like precipitates, it is necessary to perform slow cooling from a high temperature (e.g., 1200° C.) at a cooling rate of about 6° C./hr. This requires a longer time for a temperature drop, leading to poor productivity.

The present invention has been accomplished in consideration of the above-described circumstances. It is an object of the present invention to provide an NTC thermistor ceramic with a resistance that can be easily adjusted to a lower value even after sintering, a method for producing the NTC thermistor ceramic, and an NTC thermistor produced using the NTC thermistor ceramic.

Means for Solving the Problems

The inventors have found that where a ceramic green compact composed of a plurality of metal oxides containing a Mn oxide is subjected to firing treatment in accordance with a predetermined firing profile, a first phase mainly containing Mn is formed over the entire firing profile and functions as a matrix. When the temperature in a cooling step of the firing profile reaches a predetermined temperature or lower, a second phase having a crystal structure different from that of the first phase is precipitated. The second phase has a higher resistance than the first phase.

Conversely, the fact that the second phase is precipitated when the temperature in the cooling step of the firing profile reaches a predetermined temperature or lower indicates that at a predetermined temperature or higher, the high-resistance second phase disappears and is made to be equivalent to the first phase.

The inventors have focused attention on such points and have found that in the case where a ceramic main body containing the first phase and the second phase is scanned while being irradiated (heated) with laser light to form a heated region, the high-resistance second phase located in the heated region disappears due to the heat generated by irradiation and is made to be crystallographically equivalent to the first phase. This makes it possible to easily and largely adjust the resistance even after sintering.

These findings have led to the completion of the present invention. An NTC thermistor ceramic according to the present invention includes a ceramic main body including a first phase and a second phase, the first phase mainly containing Mn, and the second phase having a higher resistance than the first phase, and a heated region formed on a surface of the ceramic main body, the heated region being formed by the application of heat, in which the second phase is crystallographically equivalent to the first phase in the heated region.

The term "crystallographically equivalent" used in the present invention indicates that the crystal state of the second phase is made to be equivalent to that of the first phase. In other words, the term indicates that the second phase is changed into a phase having a crystal structure and a crystal lattice that is the same as those of the matrix, which is the first phase.

It was found that the second phase formed of plate crystals is particularly effective and is precipitated in the first phase in a dispersed state. It was also found that the second phase has a higher Mn content than the first phase and has a higher resistance than the first phase.

In the NTC thermistor ceramic according to the present invention, the second phase is formed of plate crystals mainly composed of Mn and precipitated in the first phase in a dispersed state.

The inventors have further conducted intensive studies and have found that for a $(Mn,Ni)_3O_4$-based ceramic material, the precipitation of the second phase depends on the ratio a/b of the Mn content a to the Ni content b of the ceramic main body and that a ratio a/b, in atomic percent, ranging from 87/13 to 96/4 leads to an effective precipitation of the second phase.

That is, the ceramic main body in the NTC thermistor ceramic according to the present invention, preferably contains Mn and Ni, the first phase has a spinel structure, and the ratio, in atomic percent, of the Mn content a to the Ni content b, i.e., a/b, of the entirely of the ceramic is in the range of 87/13 to 96/4.

Furthermore, it was found that for a $(Mn,Co)_3O_4$-based ceramic material, the precipitation of the second phase depends on the ratio a/c of the Mn content a to the Co content c in the ceramic main body and that a ratio a/c, in atomic percent, ranging from 60/40 to 90/10 leads to an effective precipitation of the second phase.

That is, the ceramic main body in the NTC thermistor ceramic according to the present invention, preferably contains Mn and Co, and the first phase has a spinel structure, and the ratio, in atomic percent, of the Mn content a to the Co content c, i.e., a/c, of the entirely of the ceramic is in the range of 60/14 to 90/10.

It was also found that the addition of Cu oxide has little effect on the precipitation of the second phase so long as the ratios a/b and a/c are within the above range and that thus a preferred addition of Cu is possible.

That is, the ceramic main body preferably contains a Cu oxide in the NTC thermistor ceramic according to the present invention.

A method for producing an NTC thermistor ceramic according to the present invention includes a raw-material-powder preparation step of mixing, grinding, and calcining a plurality of metal oxides including a Mn oxide to prepare a raw-material powder, a green compact formation step of subjecting the raw-material powder to a forming process to form a green compact, and a firing step of firing the green compact to form a ceramic main body, the method further including after the firing step, a heat application step of subjecting a surface of the ceramic main body to a heat treatment to form a heated region, in which in the firing step, the green compact is fired in accordance with a firing profile including a heating step, a high-temperature-holding step, and a cooling step, and a first phase serving as a matrix is formed through the entire firing profile, in which in the cooling step, which is performed at a predetermined temperature or lower, of the firing profile, a second phase having a higher resistance than the first phase is formed, and in which in the heat application step, the second phase in the heated region is made to be crystallographically equivalent to the first phase.

In the method for producing an NTC thermistor ceramic according to the present invention, the heat treatment is performed at a temperature above the predetermined temperature in the firing profile.

As a method for applying heat, pulsed laser irradiation is preferred from the viewpoint of achieving the disappearance of the second phase without the occurrence of ablation.

That is, in the method for producing an NTC thermistor ceramic according to the present invention, the heat application step is performed with a pulsed laser. Furthermore, laser light emitted from the pulsed laser preferably has an energy density of 0.3 to 1.0 $J/cm^2$.

An NTC thermistor according to the present invention includes external electrodes preferably formed on both end portions of a ceramic body, in which the ceramic body is composed of the NTC thermistor ceramic described above, and the heated region is formed in a line-like shape on a surface of the ceramic body and connects the external electrodes.

An NTC thermistor according to the present invention includes external electrodes formed on both end portions of a ceramic body, in which the ceramic body is composed of the NTC thermistor ceramic described above, and the heated region is linearly formed on a surface of the ceramic body and is arranged in parallel with the external electrodes.

An NTC thermistor according to the present invention also includes a ceramic body partitioned into a first body portion and a second body portion, a first external electrode and a second external electrode formed at one end portion of the ceramic body, a third external electrode and a fourth external electrode formed at the other end portion of the ceramic body so as to face the first external electrode and the second external electrode, respectively, a first NTC thermistor portion including the first external electrode, the first body portion, and the third external electrode, and a second NTC thermistor portion including the second external electrode, the second body portion, and the fourth external electrode, in which the ceramic body is composed of the NTC thermistor ceramic described above, and the heated region having a predetermined linear pattern is formed on a surface of one of the first NTC thermistor portion and the second NTC thermistor portion.

In the NTC thermistor according to the present invention, the heated region can be formed on the surface of the ceramic body so as to have identification information.

An NTC thermistor according to the present invention includes a ceramic body composed of the NTC thermistor ceramic described above, a plurality of external electrodes formed at both end portions of the ceramic body and spaced at predetermined intervals, and a plurality of metallic conductors formed on a surface of the ceramic body so as to correspond to the plural external electrodes, one end of each of the plural metallic conductors being connected to a corresponding one of the plural external electrodes, and each of the metallic conductors connected to the external electrodes on one side being connected to a corresponding one of the metallic conductors connected to the external electrodes on the other side with the heated regions provided therebetween, in which the plural heated regions connecting the metallic conductors are formed at predetermined positions at different distances from one end portion of the ceramic body.

Advantages

According to the NTC thermistor ceramic of the present invention, a ceramic main body includes a first phase and a second phase, the first phase mainly containing Mn, and the second phase having a higher resistance than the first phase, and a heated region formed on a surface of the ceramic main body, the heated region being formed by the application of heat, in which the second phase is crystallographically equivalent to the first phase in the heated region. Thus, in the heated region, the second phase, which has had a high resistance, has a low resistance similar to that of the first phase.

It is thus possible to obtain an NTC thermistor that can be adjusted to have a desired resistance by changing the pattern of the heated region even after sintering.

The second phase is formed of plate crystals mainly composed of Mn and precipitated in the first phase in a dispersed state. Therefore, the foregoing effect can be easily provided.

The ceramic main body contains Mn and Ni, the first phase has a spinel structure, and the ratio, in atomic percent, of the Mn content a to the Ni content b, i.e., a/b, of the entirely of the ceramic is in the range of 87/13 to 96/4. The $(Mn,Ni)_3O_4$-based material is fired, reliably precipitating the second phase on surfaces of the ceramic main body in addition to the first phase having a spinel structure.

The ceramic main body contains Mn and Co, the first phase has a spinel structure, and the ratio, in atomic percent, of the Mn content a to the Co content c, i.e., a/c, of the entirely of the ceramic is in the range of 60/14 to 90/10. The $(Mn,Co)_3O_4$-based material is fired, reliably precipitating the second phase on surfaces of the ceramic main body in addition to the first phase having a spinel structure as described above.

Even in the case where the ceramic main body contains Cu, the Cu does not influence on the precipitation of the plate crystals. Thus, the present invention is applicable to a $(Mn,Ni,Cu)_3O_4$-based material or a $(Mn,Co,Cu)_3O_4$-based material.

According to the method for producing an NTC thermistor ceramic of the present invention, a heat application step after the firing step subjecting a surface of the ceramic main body to a heat treatment to form a heated region, and in which in the firing step, the green compact is fired with a firing profile including heating, high-temperature-holding, and cooling, and a first phase serving as a matrix is formed through the entire firing profile, in which in the cooling step, which is performed at a predetermined temperature or lower, a high-resistance second phase having a higher Mn content than the first phase is formed, and in which in the heating step, the second phase in the heated region is made to be crystallographically equivalent to the first phase. That is, a low-resistance first phase is formed in the ceramic main body and the high-resistance second phase is formed on the surfaces of the ceramic main body. Then the second phase located in the heated region disappears by the heat treatment. It is thus possible to easily adjust the resistance to a lower value.

In the heating step, the heat treatment is performed at a temperature above a predetermined temperature in the firing profile. Thus, the high-resistance second phase disappears and is made to be equivalent to the first phase. Like the first phase, the second phase in the heated region has a low resistance. Therefore, the foregoing effect can be easily provided.

The heating step can be performed with laser light having an energy density of 0.3 to 1.0 $J/cm^2$, from a pulsed laser, thereby resulting in the disappearance of the second phase without the occurrence of ablation.

According to the NTC thermistor of the present invention, the ceramic body is composed of the NTC thermistor ceramic described above, and the heated region is formed in a line-like shape on a surface of the ceramic body and connects the external electrodes. It is thus possible to desirably and largely adjust the resistance even after sintering. That is, the heated region is formed in a line-like shape on the surface of the ceramic body so as to connect the external electrodes and has a lower resistance than an unheated portion. The region having a reduced resistance allows a current to flow easily and selectively therethrough. It is thus possible to adjust the resistance of the sintered ceramic body to a lower value.

According to the NTC thermistor of the present invention, it is possible to provide a high-quality small NTC thermistor having a low resistance, in which variations in resistance from thermistor to thermistor can be minimized.

The heated region is linearly formed on a surface of the ceramic body and is arranged in parallel with the external electrodes, thereby reducing the resistance of the heated region. It is thus possible to easily change the resistance and fine-tune the resistance by just adjusting the number of the heated regions formed in parallel with the external electrodes.

An NTC thermistor includes a ceramic body partitioned into a first body portion and a second body portion, a first thermistor portion including the first body portion, and a second thermistor portion including the second body portion, in which the ceramic body is composed of the NTC thermistor ceramic described above, and the heated region having a predetermined linear pattern is formed on a surface of one of the first NTC thermistor portion and the second NTC thermistor portion. The NTC thermistor portion including the heated region has a lower resistance than the NTC thermistor portion that does not including the heated region. It is thus possible to obtain many resistance values from one NTC thermistor.

The heated region can be formed on the surface of the ceramic body so as to have identification information. Thus, the identification information in the heated region can be read by laser irradiation. Information unique to the NTC thermistor can be obtained without affecting the surface shape, so that the NTC thermistor is easily distinguishable from a counterfeit product and so forth.

As described above, the resistance in the NTC thermistor of the present invention can be easily adjusted to a lower value. Furthermore, the NTC thermistor is useful as countermeasures to counterfeit products.

The NTC thermistor can include a ceramic body composed of the NTC thermistor ceramic described above, a plurality of external electrodes formed at both end portions of the ceramic body and spaced at predetermined intervals, and a plurality of metallic conductors formed on a surface of the ceramic body so as to correspond to the plural external electrodes, one end of each of the plural metallic conductors being connected to a corresponding one of the plural external electrodes, and each of the metallic conductors connected to the external electrodes on one side being connected to a corresponding one of the metallic conductors connected to the external electrodes on the other side with the heated regions provided therebetween, in which the plural heated regions each connecting the metallic conductors are formed at predetermined positions at different distances from one end portion of the ceramic body. Thus, for example, even in the case where the temperature of a heat-producing component having a relatively broad temperature distribution is detected, the temperature detection can be precisely performed by detecting the temperatures using the plural low-resistance heated regions. It is possible to provide a high-precision, high-quality NTC thermistor.

REFERENCE NUMERALS

Figure 1:
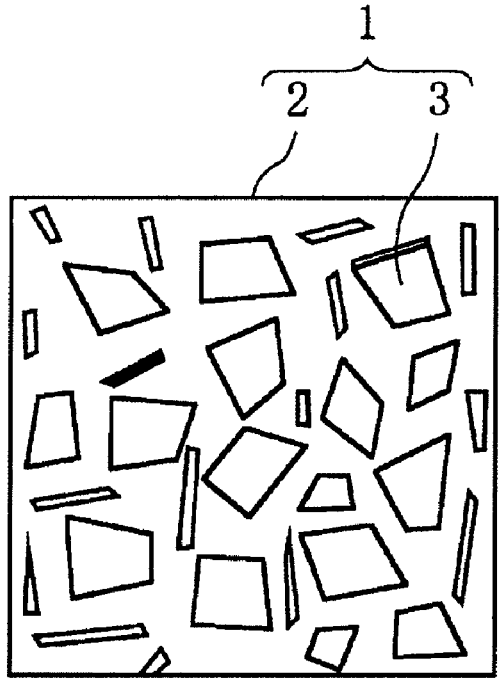
FIG. 1 is a plan view illustrating a ceramic main body used in the present invention.

1 ceramic main body
2 first phase
3 second phase
4, 12, 13, 16, 22, 32*a* to 32*c* heated region
5 heating step
6 high-temperature-holding step
7*a* first cooling substep (cooling step)
7*b* second cooling substep (cooling step)
9, 14, 15, 17, 23, 29 ceramic body
10*a*, 10*b* external electrode
17*a* first body portion
17*b* second body portion
18*a* first external electrode
18*b* second external electrode
19*a* third external electrode
19*b* fourth external electrode
24 first heated region
25 second heated region

BEST MODES FOR CARRYING OUT THE INVENTION

Embodiments of the present invention will be described in detail below.

An NTC thermistor ceramic according to an embodiment of the present invention includes a heated region having a predetermined linear pattern on a surface of a ceramic main body containing a first phase and a second phase, the first phase having a crystal structure different from the second phase.

The ceramic main body will be described below.

FIG. 1 is a plan view of a ceramic main body. The ceramic main body 1 is a sintered body composed of a ceramic material containing Mn as a main component. Specifically, the main component is a $(Mn,Ni)_3O_4$-based material or $(Mn,Co)_3O_4$-based material.

In the ceramic main body 1, a second phase is formed in a first phase 2, which serves as a matrix, in a dispersed state and has a crystal structure different from the first phase.

Specifically, the first phase 2 has a cubic spinel structure (general formula: $AB_2O_4$). The second phase 3 is formed of plate crystals (main component: $Mn_3O_4$) mainly having a tetragonal spinel structure with a higher Mn content and a higher resistance than the first phase 2.

A method for producing the ceramic main body 1 will be described below.

Predetermined amounts of $Mn_3O_4$, either or $CO_3O_4$, and, as needed, various metal oxides are weighed. The weighed raw materials are charged into a mixing and grinding machine, e.g., an attritor or ball mill, together with a dispersant and deionized water. The mixture is mixed and ground for several hours by a wet process. The resulting mixed powder is dried and calcined at 650° C. to 1000° C., preparing a raw ceramic powder.

Additives, such as a water-based binder resin, plasticizer, humectant, and antifoaming agent, are added to the raw ceramic powder and defoamed under a predetermined low vacuum, preparing a ceramic slurry. The resulting ceramic slurry is formed by a doctor blade method, lip coating method, or the like, into a ceramic green sheet with a predetermined thickness.

The ceramic green sheet is cut into pieces having predetermined dimensions. A predetermined number of pieces are stacked and press-bonded to form a laminate.

The laminate is placed in a firing furnace in an air or oxygen atmosphere, heated to 300° C. to 600° C. to perform a debinding treatment for about 1 hour, and subjected to firing in an air or oxygen atmosphere in accordance with a predetermined firing profile.

Figure 2:
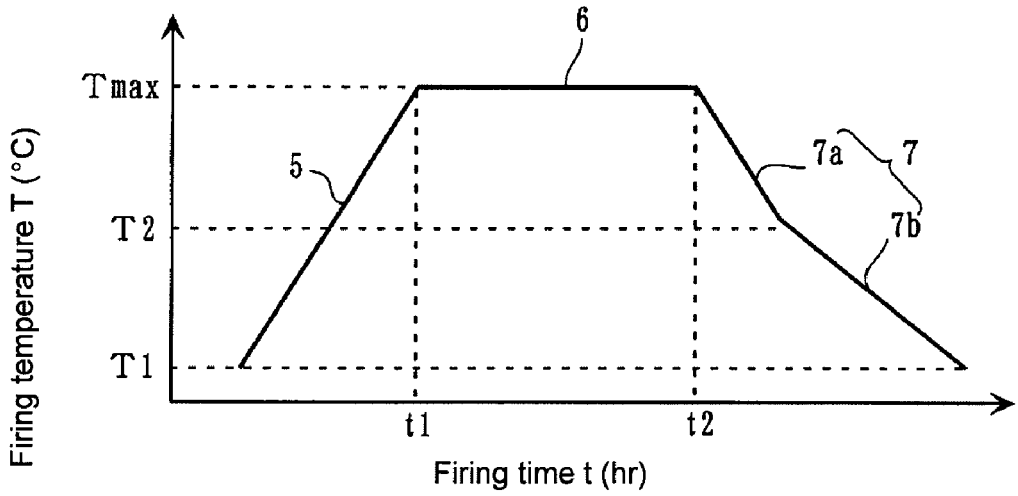
FIG. 2 illustrates an exemplary firing profile used in the present invention.

FIG. 2 illustrates an exemplary firing profile. The horizontal axis represents the firing time t (hr). The vertical axis represents the firing temperature T (° C.).

This firing profile includes a heating step 5, a high-temperature-holding step 6, and a cooling step 7. In the heating step 5 after the completion of the debinding treatment, the temperature in the firing furnace is raised from temperature T1 (e.g., 300° C. to 600° C.) to a maximum firing temperature Tmax at a constant rate of temperature increase (e.g., 200° C./hr). The high-temperature-holding step 6 is performed from time t1 at which the temperature in the furnace reaches the maximum firing temperature Tmax to time t2 with the temperature in a furnace maintained at the maximum firing temperature Tmax. The cooling step 7 begins at time t2 to reduce the temperature in the furnace to T1. Specifically, the cooling step 7 includes a first cooling substep 7*a* and a second cooling substep 7*b*. In the first cooling substep 7*a*, the temperature is lowered to temperature T2 at a first rate of temperature drop (e.g., 200° C./hr) which is the same or substantially the same as that in the heating step 5. After the temperature in the furnace reaches temperature T2, the temperature in the furnace is lowered to temperature T1 at a second rate of temperature drop which is set at about ½ of the first rate of temperature drop, thereby completing the firing treatment to form the ceramic main body 1.

In this case, a ceramic main body 1 which is a sintered body, has the first phase 2, which serves as the matrix, having the cubic spinel structure and is formed through the entire firing profile. In the second cooling substep 7*b* of the firing profile, the second phase 3 having a crystal structure different from the first phase 2 is precipitated on surfaces of the ceramic main body 1. That is, when the temperature in the furnace reaches temperature T2 or lower, the second phase 3 formed of the plate crystals mainly having a tetragonal spinel structure is precipitated in the first phase 2 in a dispersed state. Note that the rate of temperature drop in the second cooling substep 7*b* is lower than that in the first cooling substep 7*a*, so that a larger amount of plate crystals, i.e., $Mn_3O_4$, is precipitated.

The plate crystals which constitute the second phase 3 and which mainly have a cubic spinel structure have a higher Mn content than the first phase 2. Thus, the second phase 3 has a higher resistance than the first phase 2.

With respect to the crystal structure of the ceramic main body 1, the second phase 3 formed of the plate crystals mainly having the tetragonal spinel structure is dispersed in the first phase 2 having the cubic spinel structure which serves as a matrix.

Each of the plate crystals according to the present invention has a cross section with an aspect ratio, which is defined as major axis/minor axis, of more than 1 and has, for example, a plate-like shape or an acicular shape. In the case where the plate crystals are dispersed in the first phase, the application of heat causes a region where the second phase disappears to form stably, thereby adjusting the resistance more easily. Note that the aspect ratio, i.e., major axis/minor axis, of a projection drawing that is a two-dimensional projection of each of the three-dimensional plate crystals is preferably 3 or more.

For a $(Mn,Ni)_3O_4$-based ceramic material, the precipitation of the plate crystals constituting the second phase 3 depends on the ratio of the Mn content to the Ni content, i.e., a/b, of the ceramic main body 1. The ratio a/b is preferably larger than 87/13 in terms of atomic percent. This is because a ratio a/b of less than 87/13 can result in a relative reduction in Mn content, thereby causing difficulty in precipitating plate crystals rich in Mn content. The upper limit of the ratio a/b is not particularly limited from the viewpoint of the precipitation of the plate crystals. In consideration of mechanical strength and pressure resistance, the upper limit of the ratio a/b is preferably 96/4 or less.

For $(Mn,Co)_3O_4$-based ceramic material, the precipitation of the plate crystals depends on the ratio of the Mn content to the Co content, i.e., a/c, of the ceramic main body 1. The ratio a/c is preferably larger than 60/40 in terms of atomic percent. This is because a ratio a/c of less than 60/40 can result in a relative reduction in Mn content, thereby causing difficulty in precipitating plate crystals rich in Mn content. The upper limit of the ratio a/c is not particularly limited from the viewpoint of the precipitation of the plate crystals. In consideration of the reliability of resistance, the upper limit of the ratio a/c is preferably 90/10 or less.

With respect to the second phase of the present invention, a description has been made by taking the formation of the plate crystals as an example. The second phase of the present invention is not limited to the plate crystals so long as the second phase has a higher resistance than the first phase and has a crystal structure such that the second phase having a high resistance can disappear by changing the crystal structure of the second phase into a crystal structure which is the same as the crystal structure of the first phase at a predetermined temperature or higher.

Figure 3:
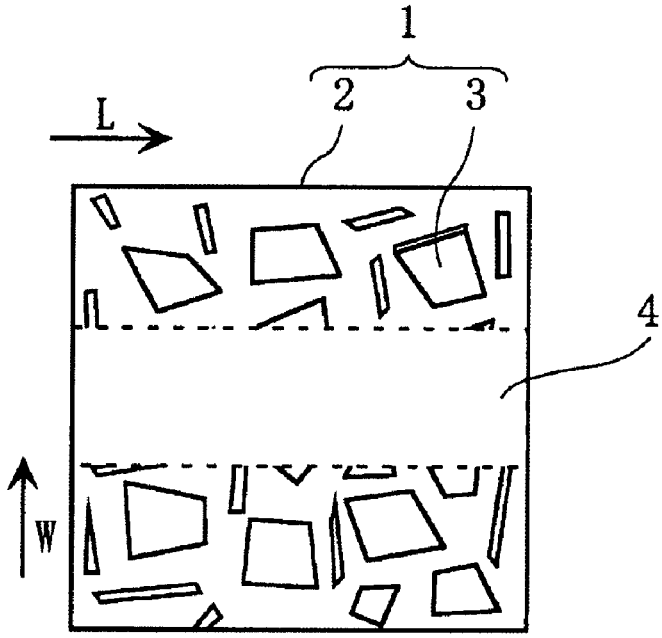
FIG. 3 is a plan view illustrating an NTC thermistor ceramic according to an embodiment of the present invention.

FIG. 3 is a plan view illustrating an NTC thermistor ceramic according to an embodiment of the present invention. The NTC thermistor ceramic includes a heated region 4 located in the substantially middle portion in the width direction W and extending in the length direction L of the ceramic main body 1. The resistance of the NTC thermistor can be adjusted by the pattern of the heated region 4.

As described above, the second phase 3 is precipitated in the second cooling substep 7*b*, in which the temperature in the furnace is temperature T2 or lower. Conversely, heating the second phase 3 to temperature T2 or higher causes the second phase 3 located at a heated portion to effectively disappear. The crystal structure is changed from the tetragonal crystal structure to the cubic crystal structure, which is the same as that of the first phase 2, thereby reducing the resistance.

In this embodiment, heating the ceramic main body 1 makes it possible to reduce the resistance of the NTC thermistor.

As means for applying heat, a pulsed laser, for example, a $CO_2$ laser, a YAG laser, an excimer laser, or a titanium-sapphire laser, is preferably used from the viewpoint of achieving the effective application of heat in a short time and the prevention of the occurrence of ablation.

Furthermore, the laser light preferably has an energy density of 0.3 to 1.0 J/cm$^2$. An energy density of laser light of less than 0.3 J/cm$^2$ fails to apply a sufficient amount of heat because of an excessively low energy density. An energy density of laser light exceeding 1.0 J/cm$^2$ can cause ablation because of an excessively large energy density.

In the case where a surface of the ceramic main body 1 is scanned while being irradiated with laser light having an energy density of 0.3 to 1.0 J/cm$^2$ emitted from a pulsed laser, a desired heated region 4 can be formed without the occurrence of ablation. In this case, heat generated by irradiation with laser light allows the second phase 3 formed in the heated region 4 to disappear.

Next, an NTC thermistor including the NTC thermistor ceramic will be described in detail.

Figure 4:
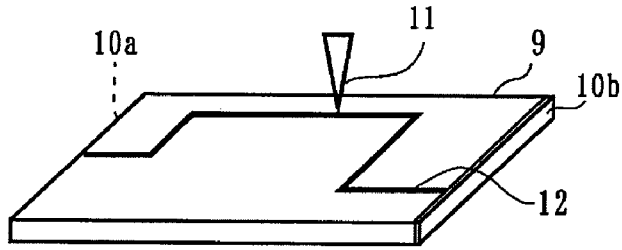
FIG. 4 is a perspective view illustrating an NTC thermistor according to an embodiment (first embodiment) of the present invention.

FIG. 4 is a perspective view illustrating an NTC thermistor according to a first embodiment of the present invention.

The NTC thermistor includes external electrodes 10*a* and 10*b* formed at both end portions of a ceramic body 9 composed of an NTC thermistor ceramic of the present invention. As a material for the external electrodes, a material mainly containing a noble metal, for example, Ag, Ag—Pd, Au, or Pt, may be used.

A heated region 12 with a predetermined linear pattern is formed on a surface of the ceramic body 9 by irradiation with laser light 11 emitted from a pulsed laser. In this first embodiment, the heated region 12 with a substantially rectangular pattern is formed on the surface of the ceramic body 9 so as to connect the external electrodes 10*a* and 10*b*.

As described above, heat generated by irradiation with the laser light 11 changes the crystal structure of the high-resistance second phase 3 precipitated in the pathway of the heated region 12 into a crystal structure which is the same as that of the first phase 2, allowing the second phase 3 to disappear. This makes it possible to reduce the resistance.

Furthermore, the heated region 12 is formed on the surface of the ceramic body 9 so as to connect the external electrodes 10*a* and 10*b*, and the heated region has a lower resistance than an unheated portion. A current flows easily through the low-resistance region. In this way, it is possible to adjust the resistance of the sintered ceramic body to a lower value.

Figure 5:
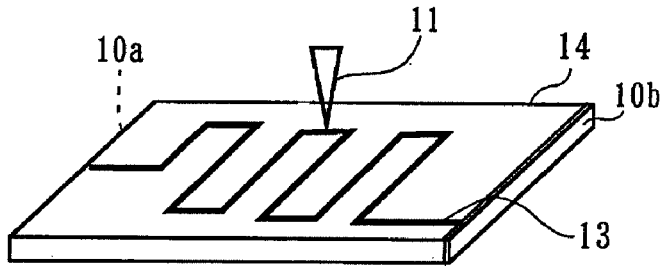
FIG. 5 is a perspective view illustrating an NTC thermistor according to a second embodiment of the present invention.

FIG. 5 is a perspective view illustrating an NTC thermistor according to a second embodiment of the present invention. In the second embodiment, a linear heated region 13 is formed on a surface of a ceramic body 14 in a pulsed pattern so as to connect the external electrodes 10*a* and 10*b*.

In this way, it is possible to form the heated region 13 having an intended pattern by adjusting the scan length of the pulsed laser. That is, by just adjusting the scan length of the pulsed laser, the high-resistance region is reduced, and the proportion of low-resistance region is increased. Even after the firing, it is possible to adjust the resistance simply.

Figure 6A:
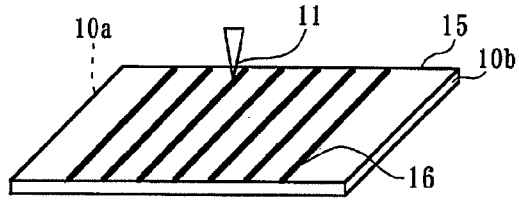
FIGS. 6(*a*) to 6(*b*) are perspective views illustrating an NTC thermistor according to a third embodiment of the present invention.
Figure 6B:
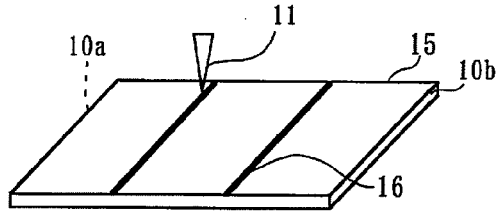

FIGS. 6(*a*) and 6(*b*) are perspective views illustrating an NTC thermistor according to a third embodiment of the present invention. In the third embodiment, at least one heated region 16 is linearly formed on a surface of a ceramic body 15 in parallel with the external electrodes 10*a* and 10*b*.

As illustrated in FIG. 6(*a*), a larger number of the heated regions 16 results in a lower resistance. As illustrated in FIG. 6(*b*), a smaller number of the heated regions 16 results in a higher resistance than that in FIG. 6(*a*).

In the third embodiment, the heated region 16 is linearly formed on the surface of the ceramic body 15 and arranged in parallel with the external electrode 10*a*, thereby reducing the resistance of the heated region 16. Thus, by just adjusting the scan length of the pulsed laser, the high-resistance region is reduced, and the proportion of a low-resistance region is increased in substantially the same way as in the second embodiment. Even after the firing, it is possible to adjust the resistance simply. Furthermore, it is possible to easily change the resistance and fine-tune the resistance by just adjusting the number of the heated regions formed in parallel with the external electrodes.

Figure 7:
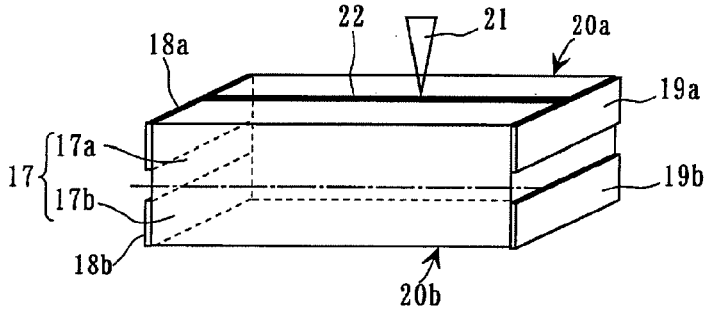
FIG. 7 is a perspective view illustrating an NTC thermistor according to a fourth embodiment of the present invention.
Figure 8:
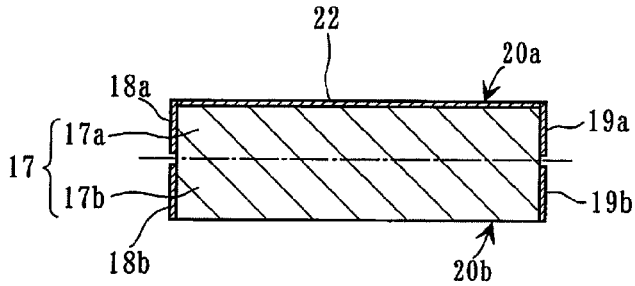
FIG. 8 is a longitudinal sectional view of the NTC thermistor illustrated in FIG. 7.

FIG. 7 is a perspective view illustrating an NTC thermistor according to a fourth embodiment of the present invention. FIG. 8 is a cross-sectional view of the NTC thermistor.

In this fourth embodiment, a first external electrode 18*a* and a second external electrode 18*b* are formed at a one end portion of a ceramic body 17 composed of the NTC thermistor ceramic of the present invention. A third external electrode 19*a* and a fourth external electrode 19*b* are formed at the other end portion of the ceramic body 17 so as to face the first external electrode 18*a* and the second external electrode 18*b*, respectively. The ceramic body 17 is partitioned into a first body portion 17*a* and a second body portion 17*b* at the substantially middle portion as a boundary. A first NTC thermistor portion 20*a* includes the first external electrode 18*a*, the first body portion 17*a*, and the third external electrode 19*a*. A second NTC thermistor portion 20*b* includes the second external electrode 18*b*, the second body portion 17*b*, and the fourth external electrode 19*b*.

A surface of the first NTC thermistor portion 20*a* is irradiated with laser light 21 emitted from a pulsed laser to form a heated region 22 that connects the first external electrode 18*a* to the third external electrode 19*a*.

In the fourth embodiment, the heated region 22 is formed on the surface of the first body portion 17*a*. Thus, the resistance of the first NTC thermistor portion 20*a* is lower than that of the second NTC thermistor portion 20*b* where a heated region is not formed. That is, as described in this fourth embodiment, a NTC thermistor includes the plural external electrodes 18*a*, 18*b*, 19*a*, and 19*b* formed at both end portions of the ceramic body 17, the first NTC thermistor portion 20*a* on which the heated region 22 is formed, and the second NTC thermistor portion 20*b* on which a heated region is not formed. It is thus possible to obtain many resistance values in one NTC thermistor.

Also in the fourth embodiment, by just adjusting the scan length of the pulsed laser, the high-resistance region is reduced, and the proportion of a low-resistance region is increased in the same way as in the other embodiments described above. It is thus possible to easily change the resistance.

According to the present invention, a high-quality small NTC thermistor having a low resistance can be produced, in which the resistance can be adjusted easily and desirably after firing and in which variations in resistance from thermistor to thermistor can be minimized.

Figure 9:
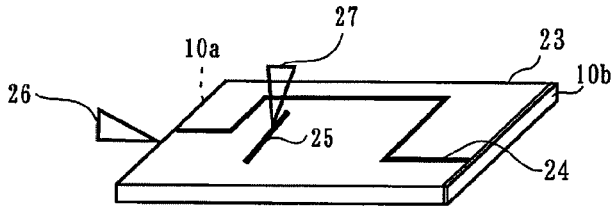
FIG. 9 is a perspective view illustrating an NTC thermistor according to a fifth embodiment of the present invention.

FIG. 9 is a perspective view illustrating an NTC thermistor according to a fifth embodiment of the present invention. In the fifth embodiment, a first heated region 24 similar to that in the first embodiment is formed on a surface of a ceramic body 23 on which the external electrodes 10*a* and 10*b* are formed at both end portions. Furthermore, in this fifth embodiment, a second heated region 25 having identification information is formed on the surface of the ceramic body 23.

That is, in the fifth embodiment, the second heated region 25 in which the product-specific identification information (for example, lot information and manufacturer information) is recorded is formed in addition to the first heated region 24 by irradiating the surface of the ceramic body 23 with laser light while the surface of the ceramic body 23 is scanned using a pulsed laser. The identification information may be line information, character information, numeric information, or the like, and is not particularly limited.

The identification information can be read by connecting one terminal 26 of the pulsed laser to the external electrode 10*a* and scanning the surface of the second heated region 25 with the other terminal 27 side.

That is, the ceramic body 23 is irradiated with laser light using the pulsed laser to form the low-resistance second heated region 25 without leaving any laser trace on the surface of the ceramic body 23. This makes it possible to record the identification information in the second heated region 25. Recording is performed without leaving any laser trail, so that no influence is exerted on the surface shape. Then the second heated region 25 is scanned with laser light to detect a current image, thereby reading the identification information. This makes it possible to easily and clearly distinguish a certified product from a non-certified (counterfeit) product.

According to the fifth embodiment, it is possible to not only adjust the resistance to a lower resistance but also distinguish whether an NTC thermistor is a certified product or non-certified product by detecting the low-resistance first heated region 24 with the current image without damaging the surface shape, which is useful as countermeasures against counterfeit products.

In the fifth embodiment, the first heated region 24 is provided as in the first embodiment. For use as the countermeasures against counterfeit products, the first heated region 24 may not be provided so long as the second heated region 25 is formed. Alternatively, the first heated region 24 itself may be handled as identification information without forming the second heated region 25.

Figure 10:
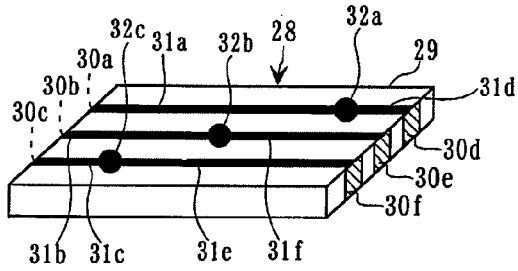
FIG. 10 is a perspective view illustrating an NTC thermistor according to a sixth embodiment of the present invention.

FIG. 10 is a perspective view illustrating an NTC thermistor according to a sixth embodiment of the present invention. In the sixth embodiment, the temperature can be detected with high precision in addition to the adjustment of the resistance.

In an NTC thermistor 28 according to the sixth embodiment, a plurality of external electrodes 30*a* to 30*f* are formed at both end portions of a ceramic body 29 and spaced at predetermined intervals. A plurality of metallic conductors 31*a* to 31*f* are formed on a surface of the ceramic body 29, one end of each of the metallic conductors 31*a* to 31*f* being connected to a corresponding one of the external electrodes 30*a* to 30*f*. The metallic conductors 31*a* to 31*c* connected to the external electrodes 30*a* to 30*c* on one side are connected to the metallic conductors 31*d* to 31*f* connected to the external electrodes 30*d* to 30*f* on the other side with heated regions 32*a* to 32*c* provided therebetween. The heated regions 32*a* to 32*c* connecting the metallic conductors 31*a* to 31*c* to the metallic conductors 31*d* to 31*f* are formed at predetermined positions at different distances from one end portion of the ceramic body 29, e.g., from the external electrodes 30*a* to 30*c*.

The NTC thermistor 28 having the structure as described above is capable of detecting the temperature of a heat-producing component mounted on an electronic circuit board with high precision.

That is, in general, heat-producing components, such as ICs, battery packs, and power amplifiers, mounted on electronic circuit boards have temperature distributions and can have local high-temperature heat spots. In the case where the temperature sensing of a heat-producing component is achieved by means of a temperature sensor such as an NTC thermistor, the temperature sensor is usually mounted in a position rather remotely from the heat-producing component. Thus, the temperature of the heat spot must be speculated on the basis of the temperature of an end portion of the heat-producing component, causing difficulty in sensing an accurate temperature.

Figure 11:
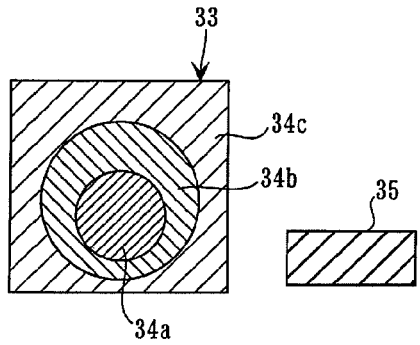
FIGS. 11(*a*) to 11(*b*) illustrates temperature distribution diagrams of heat-producing components to explain the effect of the sixth embodiment.
Figure 11:
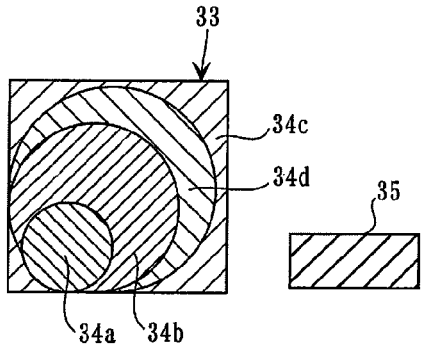

FIG. 11 illustrates exemplary temperature distributions of heat-producing components.

Referring to FIG. 11(*a*), in the case where a heat spot 34*a* (with a temperature of, for example, 100° C.) is formed in the middle of the heat-producing component 33, and usually, a circumferential portion 34*b* surrounding the heat spot 34*a* has a lower temperature (e.g., 90° C.) than the heat spot 34*a*. The peripheral portion 34*c* of the heat-producing component 33 has a lower temperature (e.g., 85° C.) than the circumferential portion 34*b*. A temperature sensor 35 is arranged at a position remote from the heat-producing component 33. Thus, the temperature sensor 35 detects the temperature of the peripheral portion 34*c* and speculates the maximum temperature of the heat-producing component 33 on the basis of the measured temperature of the peripheral portion 34*c*.

As illustrated in FIG. 11(*b*), however, in the case where the heat spot 34*a* is shifted from the middle portion of the heat-producing component 33 for any reason, the temperature decreases usually with increasing distance from the heat spot 34*a*. Assuming that the heat spot 34*a* has a temperature of 100° C., the circumferential portion 34*b* has a temperature of, for example, 90° C., the circumferential portion 34*d* has a temperature of, for example, 85° C., and the peripheral portion 34*c* of the heat-producing component 33 has a temperature of, for example, 80° C. In the case where the heat spot 34*a* is shifted from the middle portion of the heat-producing component 33, the peripheral portion 34*c* has a low temperature compared with the case where the heat spot 34*a* is present in the middle portion of the heat-producing component 33 (FIG. 11(*a*)). In this case, the temperature sensor 35 is arranged at a position remote from the heat-producing component 33 and thus detects the temperature, e.g., 80° C., of the peripheral portion 34*c*. Hence, in the case where the heat spot 34*a* is shifted from the middle portion of the heat-producing component 33 illustrated in FIG. 11(*b*), a rise in temperature can be determined to be small compared with the case illustrated in FIG. 11(*a*), thus failing to perform temperature sensing with high precision.

For the NTC thermistor 28 according to the sixth embodiment, the plural heated regions 32*a* to 32*c* are formed on the surface of the ceramic body 29. Temperatures at a plurality of positions of the heat-producing component 33 are detected with the heated regions 32*a* to 32*c*. It is determined that a region where the maximum temperature is detected has a temperature close to the temperature of the heat spot 34*a*. Furthermore, it is possible to detect temperatures of positions of the heat-producing component 33 with high precision.

Figure 12:
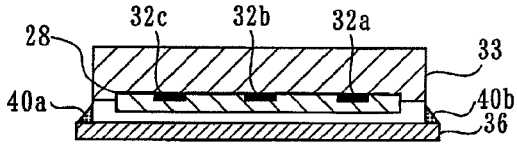
FIG. 12 is a cross-sectional view illustrating an example of the application of the sixth embodiment.

FIG. 12 illustrates an example of the application of the NTC thermistor 28 according to the sixth embodiment.

The heat-producing component 33 is mounted on a substrate 36 with solder portions 40*a* and 40*b*. The NTC thermistor 28 is arranged under the heat-producing component 33 and detects the temperatures in the plural heated regions 32*a* to 32*c*.

Among the temperatures detected in the plural heated regions 32*a* to 32*c*, it is determined that a region where the maximum temperature is measured has a temperature closer to the heat spot 34*a*. For example, in the case where the heat spot 34*a* is present in the middle portion of the heat-producing component 33, the temperature detected in a heated region 32*b* is close to the temperature of the heat spot 34*a*. In the case where the heat spot 34*a* is shifted from the middle portion of the heat-producing component 33, for example, a temperature detected in a heated region 32*a* or heated region 32*c* is close to the temperature of the heat spot 34*a*.

According to the sixth embodiment, the plural heated regions 32*a* to 32*c* are formed on the surface of the ceramic body 29 and arranged at predetermined positions at different distances from one end portion of the ceramic body 29. The temperature of the heat-producing component 33 is detected in the heated regions 32*a* to 32*c*, thus resulting in temperature sensing with high precision.

The NTC thermistor 28 is produced as described below.

A ceramic main body having predetermined dimensions (for example, width W: 30 mm, length L: 30 mm, and thickness T: 0.5 mm) is produced in the same method and procedure as those in the first embodiment. A conductive paste mainly composed of a noble metal, e.g., Ag, Ag—Pd, Au, or Pt, is applied on both end portions of the ceramic main body to form a plurality of conductive films separated at predetermined intervals.

The conductive paste is applied on the surface of the ceramic main body other than at portions to be subjected to laser irradiation to form lines in such a manner that one end of each of the lines is electrically connected to a corresponding one of the conductive films. Next, a baking treatment is performed at a predetermined temperature (for example, 750° C.) to form the external electrodes 30*a* to 30*f* and the metallic conductors 31*a* to 31*f*.

Then predetermined portions are irradiated using a pulsed laser at a predetermined laser power (for example, a power of 5 mW) in such a manner that each of the predetermined portions has a predetermined irradiation area (for example, with a diameter of 0.5 mm), forming the heated regions 32*a* to 32*c*. Thereby, the NTC thermistor 28 is produced.

Figure 13:
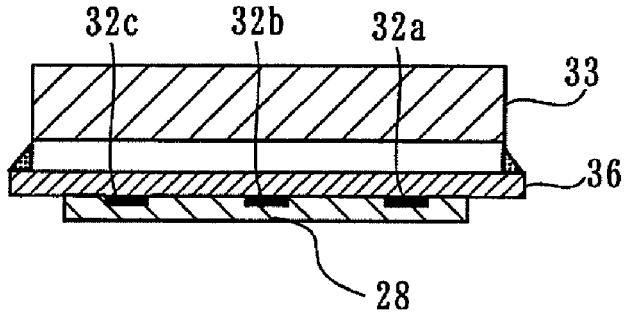
FIGS. 13(*a*) to 13(*c*) illustrates cross-sectional views of other examples of the application of the sixth embodiment.
Figure 13:
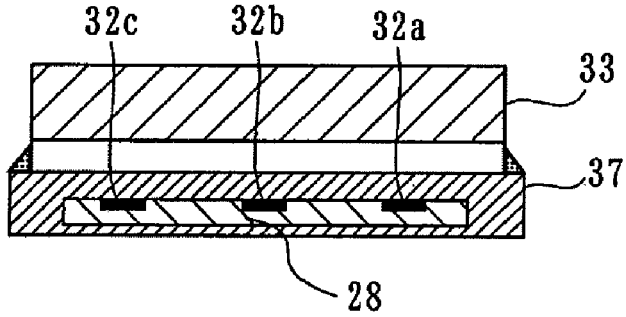
Figure 13:
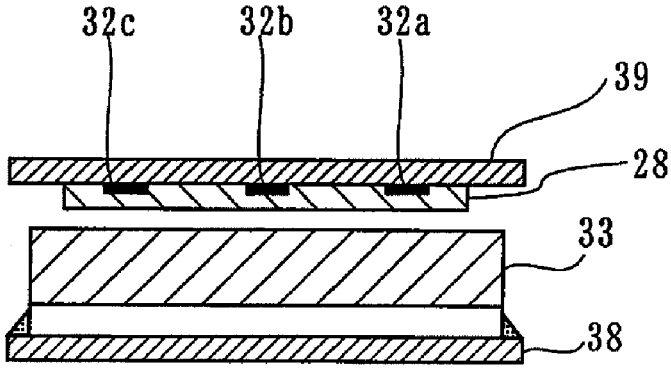

FIG. 13 illustrates cross-sectional views of other examples of the application of the sixth embodiment.

Referring to FIG. 13(*a*), the NTC thermistor 28 is mounted on the back surface of the substrate 36 and detects the temperature of the heat-producing component 33 mounted on the front surface of the substrate 36. FIG. 13(*b*) illustrates the case where the NTC thermistor 28 is arranged in a substrate 37. The temperature sensing of the heat-producing component 33 mounted on the surface of the substrate 37 is performed with the NTC thermistor 28. FIG. 13(*c*) illustrates the case where the heat-producing component 33 is mounted on the surface of a first substrate 38 and where the NTC thermistor 28 is mounted on the back surface of a second substrate 39 so as to face the heat-producing component 33. The temperature sensing is performed with the NTC thermistor 28 from above the heat-producing component 33. The use of the NTC thermistor 28 of the present invention for various electronic circuit designs makes it possible to detect the temperature of the heat-producing component 33 with high precision.

In the sixth embodiment, the surface mount NTC thermistor 28 is exemplified. It will be obvious that the present invention is also applicable to an NTC thermistor with leads and a component in which the exterior of an NTC thermistor with leads is coated with an epoxy resin or the like.

The present invention is not limited to the foregoing embodiments. Various modifications can be made within the range in which an intended purpose is achieved.

For example, with respect to a ceramic material contained in the ceramic main body 1 or the ceramic body 9, 14, 15, 17, 23, or 29, a $(Mn,Ni)_3O_4$-based ceramic material or $(Mn,Ni)_3O_4$-based ceramic material may be a main component. A small amount of an oxide of Cu, Al, Fe, Ti, Zr, Ca, Sr, or the like is preferably added thereto, as needed.

In the foregoing embodiment, the single-plate NTC thermistors that do not include an inner electrode are exemplified. It will be obvious that the embodiment is also applicable to a laminated type including inner electrodes. In this case, as a material for the inner electrodes, a material mainly containing a noble metal, e.g., Ag, Ag—Pd, Au, or Pt, or a base metal such as Ni, may be appropriately used.

Furthermore, in each of the embodiments, the case where the second phase 3 is formed of plate crystals has been described. The second phase 3 is not limited to the plate crystals so long as the second phase 3 has a higher resistance than the first phase 2.

Examples of the present invention will be specifically described below

Example 1

$Mn_3O_4$, NiO, and CuO were weighed and mixed in such a manner that after firing, the Mn, Ni, and Cu contents satisfy the expression Mn/Ni/Cu=80.1/8.9/11.0 (Mn/Ni=90/10) in terms of atomic percent (atom %). Deionized water and ammonium polycarboxylate serving as a dispersant were added to the mixture. The resulting mixture was charged into a ball mill containing partially-stabilized zirconia (PSZ) balls, wet-mixed and ground for several hours.

The resulting mixed powder was dried and then calcined at 800° C. for 2 hours to form a ceramic raw-material powder. Deionized water and the dispersant were added to the ceramic raw-material powder. The resulting mixture was wet-mixed and ground in a ball mill for several hours. An acrylic resin serving as an aqueous binder resin, a plasticizer, a humectant, and an antifoaming agent were added to the resulting mixed powder. The resulting mixture was subjected to a defoaming treatment at a low degree of vacuum of $6.65\times10^4$ to $1.33\times10^5$ Pa (500 to 1000 mmHg) to form a ceramic slurry. The ceramic slurry was subjected to a forming process on a carrier film formed of a polyethylene terephthalate (PET) film by a doctor blade method, followed by drying to form a ceramic green sheet having a thickness of 20 to 50 μm.

The resulting ceramic green sheet was cut into pieces having predetermined dimensions. A predetermined number of the pieces of the ceramic green sheet was stacked and press-bonded at about $10^6$ Pa, forming a laminated article.

The laminated article was cut into a predetermined shape. The resulting laminated article was heated at 500° C. for 1 hour in an air atmosphere to perform a debinding treatment. Then, the article was held at a maximum temperature of 1100° C. for 2 hours in an air atmosphere to perform a firing treatment.

As illustrated in FIG. 2, the firing profile of the firing treatment includes a heating step, a high-temperature-holding step, and a cooling step. In the heating step, after the completion of the debinding treatment, the temperature was raised to the maximum firing temperature of 1100° C. at a rate of temperature increase of 200° C./hr. In the subsequent high-temperature-holding step, the article was held at 1100° C. for 2 hours for firing. The temperature range of the first cooling substep was between 1100° C. and 800° C. The temperature range of the second cooling substep was less than 800° C. The rate of temperature drop in the first cooling substep was 200° C./hr. The rate of temperature drop in the second cooling substep was 100° C./hr. The firing treatment was performed under the above conditions, thereby producing a ceramic body.

A structural change was observed by a high-temperature X-ray diffraction (XRD) method using an X-ray diffractometer with a specimen heated during the firing treatment. The results demonstrated that the first phase having a spinel structure was detected over the entire firing treatment. In addition, a second phase (plate crystals) composed of $Mn_3O_4$ began to be detected at a temperature of about 800° C. In the second cooling substep, the number of $Mn_3O_4$ detected was gradually increased as the temperature approached 500° C.

In this Example, a desired firing treatment was performed in a short time without the need for slow cooling (6° C./hr) as described in Non-Patent Document 1.

Next, the microstructure of a surface of the ceramic body was observed with a scanning ion microscope (hereinafter, abbreviated to "SIM").

Figure 14:
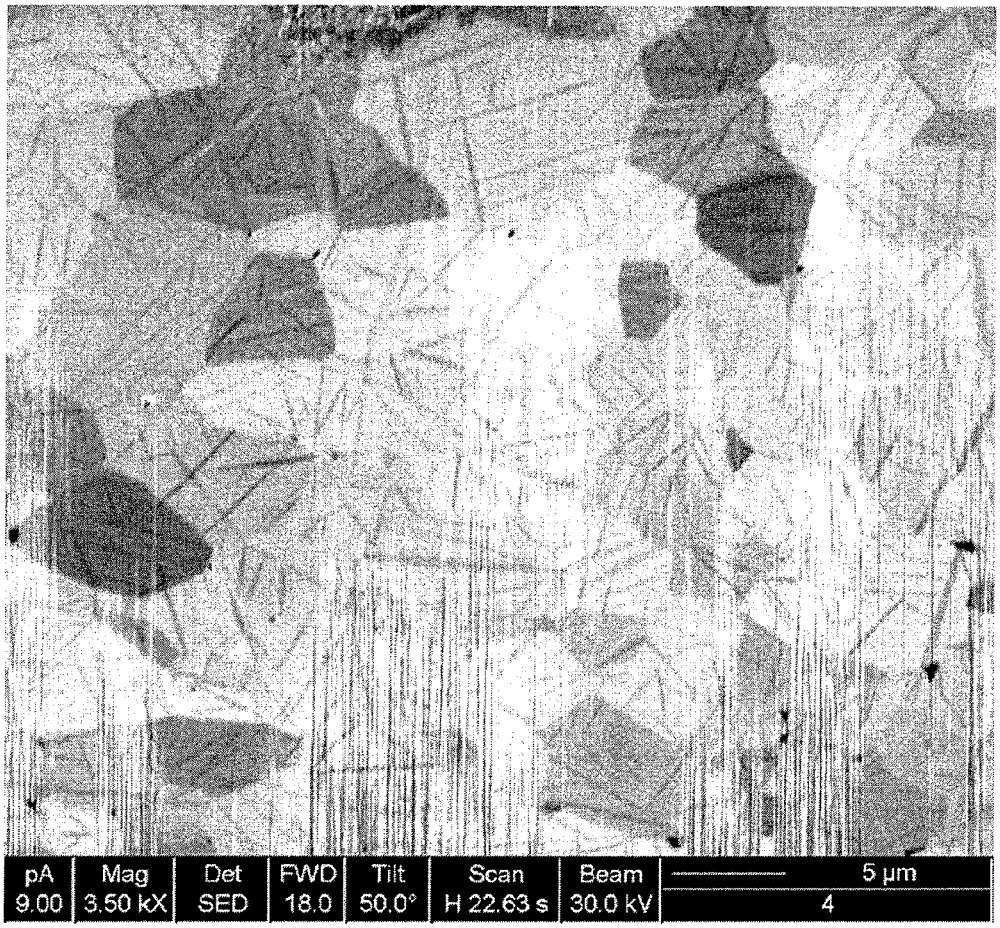
FIG. 14 is an SIM image of a ceramic body of Example 1.

FIG. 14 is an SIM image. FIG. 14 clearly showed that the second phase formed of plate crystals was dispersed in the first phase.

Next, three sampling points of the ceramic body were subjected to elemental analysis by an STEM-EDX method using a scanning transmission electron microscope (hereinafter, abbreviated to "STEM") and an energy-dispersive X-ray spectroscope (hereinafter, abbreviated to "EDX"), to identify the composition of the ceramic.

Figure 15:
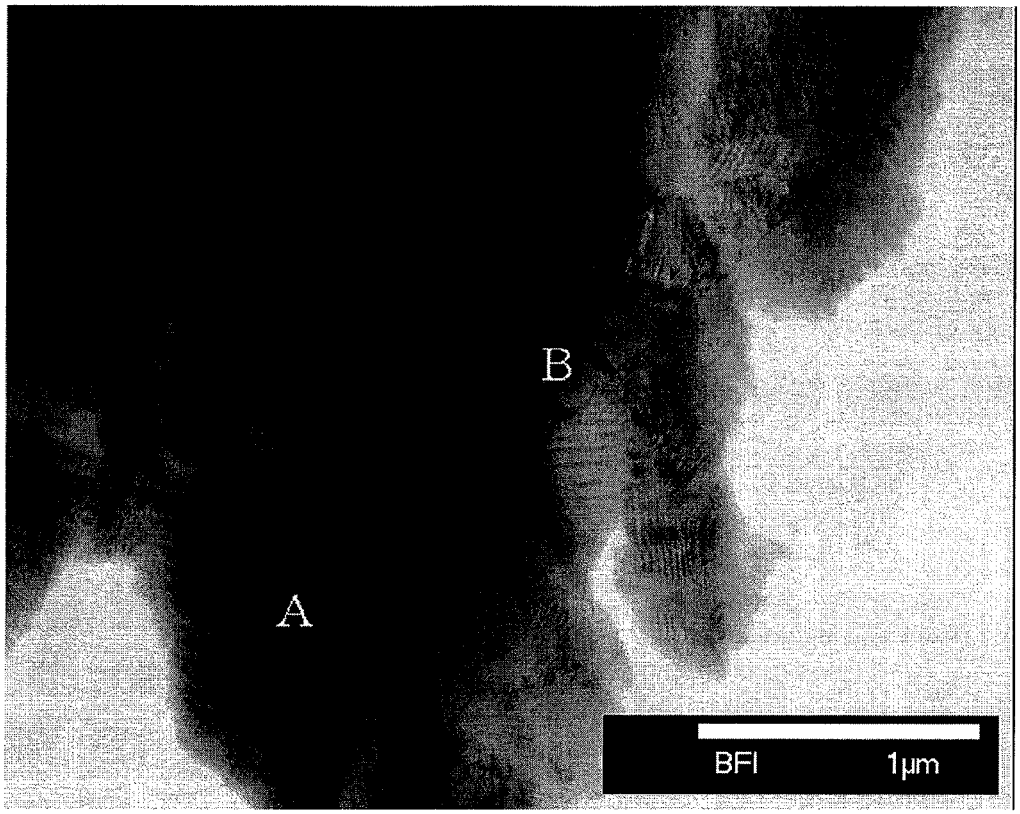
FIG. 15 is an STEM image of the ceramic body of Example 1.

FIG. 15 is an STEM image. Table 1 shows the results of quantitative analysis with the EDX. In FIG. 15, A indicates the first phase, and B indicates the second phase.

TABLE 1

| Component | First phase (A) (at. %) | Second phase (B) (at. %) |
|---|---|---|
| Mn | 68.8 to 75.5 | 95.9 to 97.2 |
| Ni | 11.3 to 13.7 | 0.6 to 1.2 |
| Cu | 13.1 to 19.9 | 2.1 to 3.0 |

As is apparent from Table 1, the Mn content of the first phase (A) was 68.8 to 75.5 atomic percent, whereas the Mn content of the second phase (B) was 95.9 to 97.2 atomic percent. That is, the results demonstrated that the second phase (B) formed of plate crystals has a higher Mn content than the first phase (A).

The resistance at each sampling point was directly measured by analysis using a scanning probe microscope (hereinafter, abbreviated to "SPM"). The results demonstrated that the second phase has a resistance at least 10 or more times that of the first phase.

The foregoing results demonstrated that in the foregoing sample, the second phase formed of the plate crystals is dispersed in the first phase and that the second phase has a higher Mn content than the first phase and has a high resistance.

Example 2

Preparation of Sample $Mn_3O_4$ and NiO were weighed and mixed in such a manner that after firing, the ratios a/b, in atomic percent, of the Mn contents a to the Ni contents b were equal to those shown in Table 2. Then ceramic bodies for samples 1 to 6 were produced in the same method and procedure as those described in "Example 1".

Next, a conductive paste mainly containing Ag was prepared. The conductive paste was applied on both end portions of each of the ceramic bodies and baked at 700° C. to 800° C. Then, the ceramic bodies were cut with a dicing saw to produce samples 1 to 6 each having a width W of 10 mm, a length L of 10 mm, and a thickness T of 2.0 mm.

Analysis of Crystal Structure

Surfaces of each of samples 1 to 6 were observed with the SIM to check the presence or absence of the precipitation of plate crystals (second phase).

Measurement of Electric Properties

For each of samples 1 to 6, the electrical resistances $R_{25}$ and $R_{50}$ at 25° C. and 50° C. were measured by a DC four-probe method (using a multimeter, model 3458A, manufactured by Hewlett-Packard Japan, Ltd). A resistivity ρ (Ωcm) at 25° C. was calculated using expression (1). In addition, the a B constant indicating a change in resistance between 25° C. and 50° C. was determined using expression (2).

$$\rho = R_{25} \cdot W \cdot T / L \tag{1}$$

$$B = \frac{\ln R_{25} - \ln R_{50}}{\frac{1}{273.15+25} - \frac{1}{273.15+50}} \tag{2}$$

Table 2 shows the compositions, the presence or absence of plate crystals, and electrical properties of samples 1 to 6.

TABLE 2

| | Ratio a/b of Mn | | Electrical properties | |
|---|---|---|---|---|
| Sample | content a to Ni content b | Plate crystal | Resistivity ρ (Ωcm) | B constant (K) |
| 1* | 80/20 | None | 1920 | 3960 |
| 2* | 84/16 | None | 2334 | 3920 |
| 3 | 87/13 | Present | 17600 | 4215 |
| 4 | 90/10 | Present | 26890 | 4243 |
| 5 | 93/7 | Present | 80473 | 4375 |
| 6 | 96/4 | Present | 269383 | 4583 |

*Outside the range of the present invention

In samples 1 and 2, precipitation of plate crystals was not observed. The reason for this is probably as follows: For the $(Mn,Ni)_3O_4$-based material, the precipitation of the plate crystals is believed to depend on the ratio a/b of the Mn content to the Ni content b. In each of samples 1 and 2, the ratio a/b was low. In other words, the Mn content needed to precipitate $Mn_3O_4$, which crystallizes in plates, was relatively low.

In contrast, the ratio a/b of the Mn content a to the Ni content b in each of samples 3 to 6 was in the range of 87/13 to 96/4. That is, the Mn content was sufficiently high, causing the precipitation of plate crystals.

Example 3

$Mn_3O_4$, NiO, and CuO were weighed and mixed in such a manner that after firing, the ratios a/b, in atomic percent, of the Mn contents a to the Ni contents b and the Cu content were equal to those shown in Table 3. Samples 11 to 13 having the same outer diameter as in "Example 2" were produced in the same method and procedure as those described in "Example 2".

Next, each of samples 11 to 13 was examined for the presence or absence of the precipitation of plate crystals, and electrical properties were measured, in the same method and procedure as those described in "Example 2".

Table 3 shows the compositions, the presence or absence of the precipitation of plate crystals (second phase), and electrical properties of samples 11 to 13.

TABLE 3

| Sample | Ratio a/b of Mn content a to Ni content b | Cu (at. %) | Plate crystals | Electrical properties Resistivity ρ (Ωcm) | B constant (K) |
|---|---|---|---|---|---|
| 11 | 87/13 | 15.0 | Present | 102 | 2766 |
| 12 | 90/10 | 4.5 | Present | 1220 | 3212 |
| 13 | 96/4 | 15.0 | Present | 513 | 2768 |

As is apparent from Table 3, samples 11 to 13 are samples in which Cu is added to samples 3, 4, and 6 in "Example 2".

The results demonstrated that when the ratio a/b of the Mn content a to the Ni content b is in the range of 87/13 to 96/4, the precipitation of the plate crystals is not influenced by the addition of Cu.

Example 4

$Mn_3O_4$, $CO_3O_4$, and CuO were weighed and mixed in such a manner that after firing, the ratios a/c, in atomic percent, of the Mn content to the Co content c and the Cu content were equal to those shown in Table 4. Samples 21 to 26 having the same outer diameter as in "Example 2" were produced in the same method and procedure as those described in "Example 2".

Next, each of samples 21 to 26 was examined for the presence or absence of the precipitation of plate crystals (second phase), and electrical properties were measured, in the same method and procedure as those described in "Example 2".

Table 4 shows the compositions, the presence or absence of the precipitation of plate crystals, and electrical properties of samples 21 to 26.

TABLE 4

| Sample | Ratio a/c of Mn content a to Co content c | Cu (at. %) | Plate crystals | Electrical properties Resistivity ρ (Ωcm) | B constant (K) |
|---|---|---|---|---|---|
| 21* | 25/75 | 1.5 | None | 434 | 3839 |
| 22* | 35/65 | 1.5 | None | 193 | 3840 |
| 23* | 45/55 | 1.5 | None | 197 | 3908 |
| 24 | 60/40 | 5.0 | Present | 453 | 3684 |
| 25 | 80/20 | 16.7 | Present | 129 | 2783 |
| 26 | 90/10 | 17.0 | Present | 237 | 2732 |

*Outside the range of the present invention

In samples 21 to 23, the precipitation of plate crystals was not observed. The reason for this is probably as follows: For the $(Mn,Co,Cu)_3O_4$-based material, the precipitation of the plate crystals is believed to depend on the ratio a/c of the Mn content to the Co content c. In each of samples 21 to 23, the ratio a/c was low. In other words, the amount of Mn needed to precipitate the plate crystals was relatively low.

In contrast, the ratio a/c of the Mn content a to the Co content c in each of samples 24 to 26 was in the range of 60/40 to 90/10. That is, the Mn content was sufficiently high, causing the precipitation of plate crystals.

Example 5

A titanium-sapphire laser was used as a pulsed laser. A surface of sample 12 was irradiated with laser light at an energy density of 0.5 to 1.0 J/cm$^2$. The surface of the sample was observed before and after the laser irradiation using the SIM to check the state of the ceramic.

Figure 16:
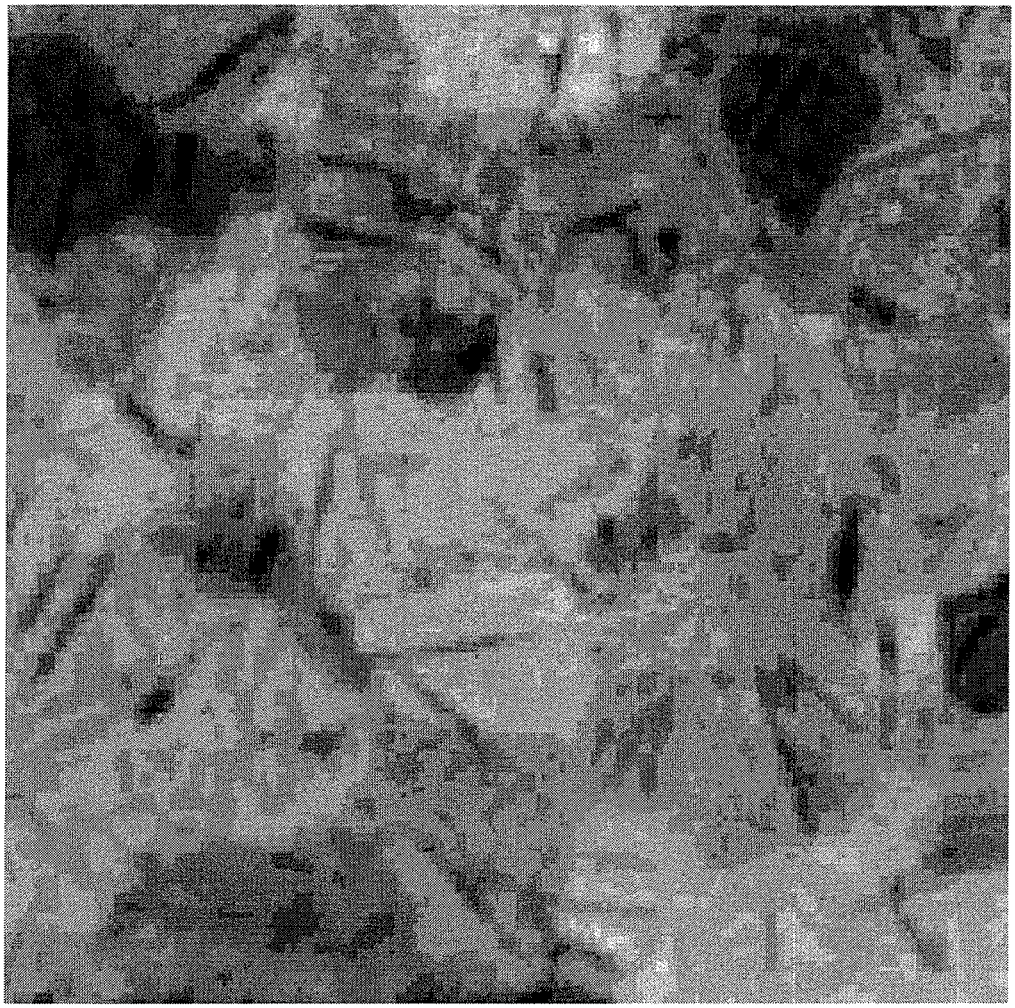
FIG. 16 is an SIM image before laser irradiation in Example 5.
Figure 17:
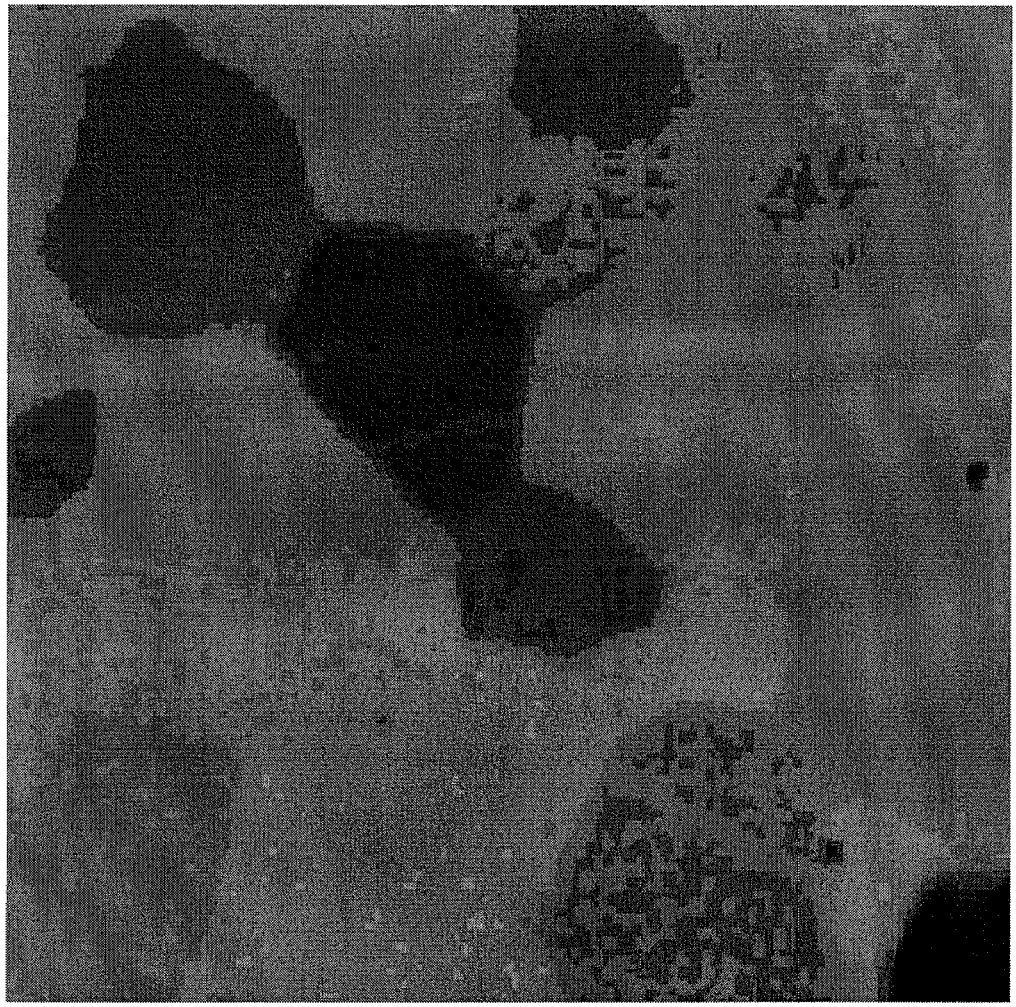
FIG. 17 is an SIM image after the laser irradiation in Example 5.

FIG. 16 is an SIM image before the laser irradiation. FIG. 17 is an SIM image after the laser irradiation.

A comparison between FIGS. 16 and 17 clearly showed that local heating with the laser light causes a slight increase in the size of the ceramic grains and a sharp decrease in the number of the plate crystals (second phase) having a high resistance. That is, the irradiation with the laser light (heat application) causes the disappearance of the high-resistance second phase, thereby achieving a low-resistance state similar to the first phase. In this way, it was found that the resistance can be easily adjusted even after firing.

Example 6

Sample 12 was irradiated with laser light. The resistance $R_{25}$ at 25° C. was measured by the DC four-probe method as in "Example 2".

Figure 18:
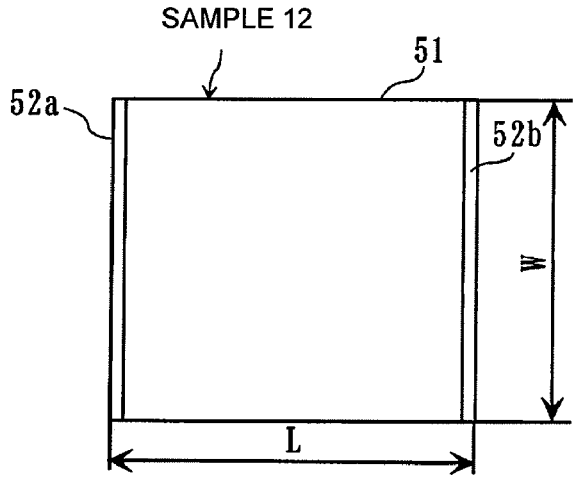
FIG. 18(*a*) is a plan view illustrating sample 12 of Example 3, FIGS. 18(*b*) and 18(*c*) are plan views illustrating samples 31 and 32 produced in Example 6.
Figure 18:
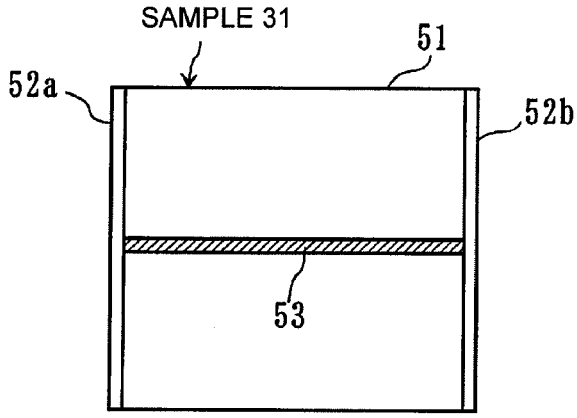
Figure 18:
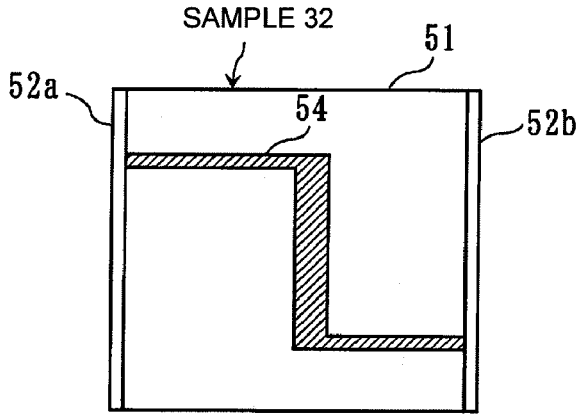
Figure 19A:
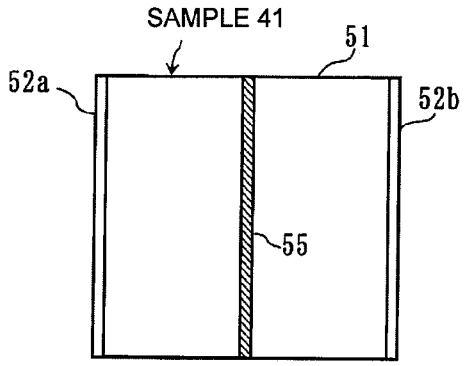
FIG. 19(*a*) to (*d*) illustrates plan views of samples 41 to 44 produced in Example 7.
Figure 19B:
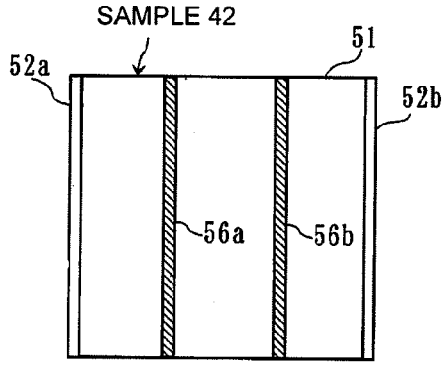
Figure 19C:
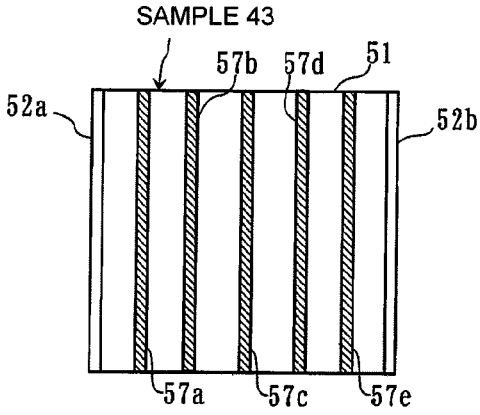
Figure 19D:
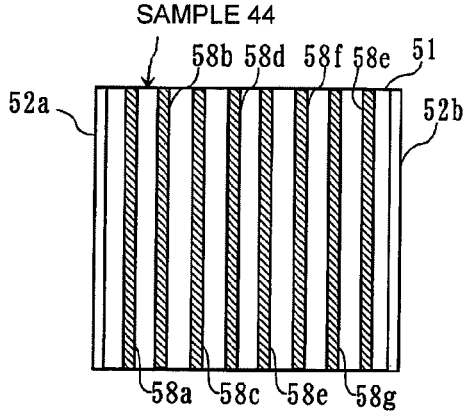

As illustrated in FIG. 18(*a*), sample 12 has a width W of 10 mm, a length L of 10 mm, and a thickness T of 2.0 mm. External electrodes 52*a* and 52*b* are formed at both end portions of a ceramic main body 51. The sample 12 had a resistance $R_{25}$ of 6.1 kΩ at 25° C. (room temperature).

As illustrated in FIG. 18(*b*), the middle portion of a surface of the ceramic main body 51 was linearly scanned by a pulsed laser (not shown) between the external electrode 52*a* and the external electrode 52*b* while laser irradiation was performed, forming a heated region 53. Thereby, sample 31 was produced.

Similarly, as illustrated in FIG. 18(*c*), a surface of the ceramic main body 51 was scanned by a pulsed laser (not shown) in a hook-like shape between the external electrode 52*a* and the external electrode 52*b* while laser irradiation was performed, forming a heated region 54. Thereby, sample 32 was produced.

In each of samples 31 and 32, the resistance $R_{25}$ at 25° C. was measured by the DC four-probe method as in "Example 2". The results were as follows: Sample 31 had a resistance of 1.3 kΩ; and Sample 32 had a resistance of 1.7 kΩ.

The resistance $R_{25}$ of sample 12 before the laser irradiation was 6.1 kΩ. The results demonstrated that the formation of the heated regions 53 and 54 by irradiation with laser light reduces the resistance at room temperature to about ⅕ and that the resistance can be easily adjusted by just changing the pattern of the heated region.

In Example 6, sample 32 has a higher resistance $R_{25}$ than sample 31. The reason for this is probably that the entire length of the heated region 54 of sample 32 is greater than that of the heated region 53 of sample 31, so that the longer pathway leads to an increase in resistance.

Example 7

Sample 12 was prepared as in "Example 6".

As illustrated in FIG. 19(*a*), the middle portion of a surface of the ceramic main body 51 was irradiated with laser light while being linearly scanned by a pulsed laser (not shown) in parallel with the external electrodes 52*a* and 52*b*, forming one heated region 55. Thereby, sample 41 was produced.

Similarly, as illustrated in FIG. 19(*b*), two heated regions 56*a* and 56*b* were formed in parallel with 52*a* and 52*b*, producing sample 42.

Similarly, as illustrated in FIG. 19(*c*), five heated regions 57*a* to 57*e* were formed in parallel with 52*a* and 52*b* so as to be arranged at substantially regular intervals, thereby producing sample 43.

Similarly, as illustrated in FIG. 19(*d*), eight heated regions 58*a* to 58*h* were formed in parallel with 52*a* and 52*b* so as to be arranged at substantially regular intervals, thereby producing sample 44.

In each of samples 41 to 44, the resistance $R_{25}$ at 25° C. was measured by the four-probe method as in "Example 2". The results were as follows: Sample 41 had a resistance of 5.5 kΩ; Sample 42 had a resistance of 5.0 kΩ; Sample 43 had a resistance of 3.2 kΩ; and Sample 44 had a resistance of 1.5 kΩ.

The resistance $R_{25}$ of sample 12 before the laser irradiation was 6.1 kΩ. The formation of the eight heated regions 58*a* to 58*h* as illustrated in FIG. 19(*d*) reduced the resistance from 6.1 kΩ to 1.5 kΩ. That is, the room-temperature resistance was reduced to about ¼ of the initial resistance. In the case where one heated region 55 was formed as illustrated in FIG. 19(*a*), the room-temperature resistance was reduced from 6.1 kΩ to 5.5 kΩ. The results demonstrated that the resistance is capable of being fine-tuned.

In this way, the formation of the heated regions 55, 56*a*, 56*b*, 57*a* to 57*c*, and 58*a* to 58*h* by irradiation with laser light in parallel with the external electrodes 52*a* and 52*b* made it possible to desirably adjust the room-temperature resistance.

Example 8

Figure 20:
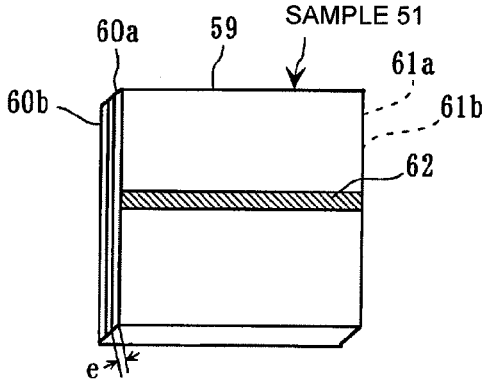
FIG. 20 is a perspective view illustrating sample 51 produced in Example 8.

As illustrated in FIG. 20, first and second external electrodes 60*a* and 60*b* were formed at one end portion of a ceramic body 59 having the same composition as sample 12. Third and fourth external electrodes 61*a* and 61*b* were formed at the other end portion thereof so as to face the first and second external electrodes 60*a* and 60*b*. The electrode width e of each of the first to fourth external electrodes 60*a*, 60*b*, 61*a*, and 61*b* was 0.7 mm.

A portion between the first external electrode 60*a* and the third external electrode 61*a* was linearly scanned while pulsed laser irradiation was performed, forming a heated region 62. Thereby, sample 51 was produced.

The resistance $R_{25}$ of sample 51 at 25° C. was measured by the four-probe method as in "Example 2". The results were as follows: The resistance $R_{25}$ between the first external electrode 60*a* and the third external electrode 61*a* was 4.7 kΩ; and the resistance $R_{25}$ between the second external electrode 60*b* and the fourth external electrode 61*b* was 17.4 kΩ.

That is, the formation of the heated region 62 resulted in a reduction in resistance $R_{25}$ between the first external electrode 60*a* and the third external electrode 61*a* and an increase in the resistance $R_{25}$ of a portion, in which the heated region 62 was not formed, between the second external electrode 60*b* and the fourth external electrode 61*b*.

Thus, the formation of the heated region 62 made it possible to widely adjust the room-temperature resistance.

Example 9

A ceramic main body with the same composition as sample 12 was prepared, the ceramic main body having a width W of 10 mm, a length L of 10 mm, and a thickness T of 0.15 mm. A Ag electrode was formed on one surface of the ceramic main body. Laser irradiation was performed on the other surface at a pulsed laser energy density of 0.55 J/cm$^2$, thereby producing sample 61.

Sample 62 was produced in the same method and procedure as those for sample 61, except that the pulsed laser energy density was set to 1.10 J/cm$^2$.

Sample 63 was produced in the same method and procedure as those for sample 61, except that the pulsed laser energy density was set to 0.22 J/cm$^2$.

Surface shapes and current images of samples 61 to 63 were observed with the SPM.

Figure 21A:
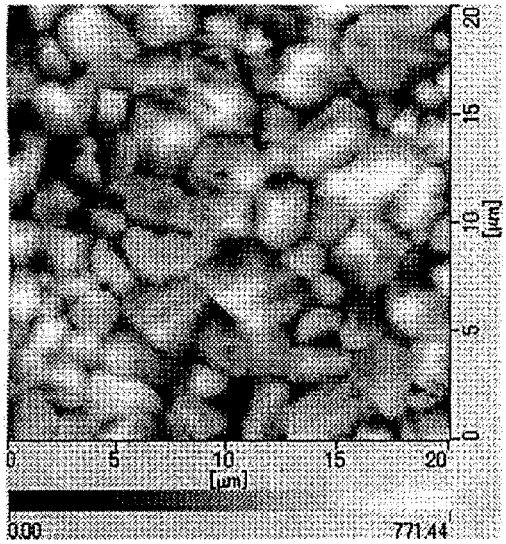
FIGS. 21(*a*) to 21(*b*) illustrates SIM images of sample 61 produced in Example 9.
Figure 21B:
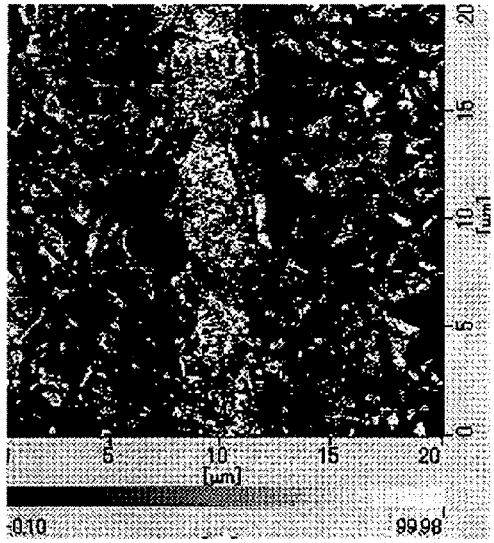
Figure 22A:
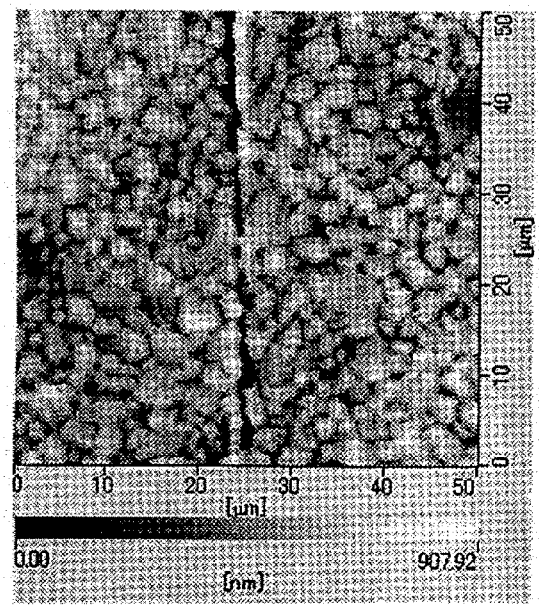
FIGS. 22(*a*) to 22(*b*) illustrates SIM images of sample 62 produced in Example 9.
Figure 22B:
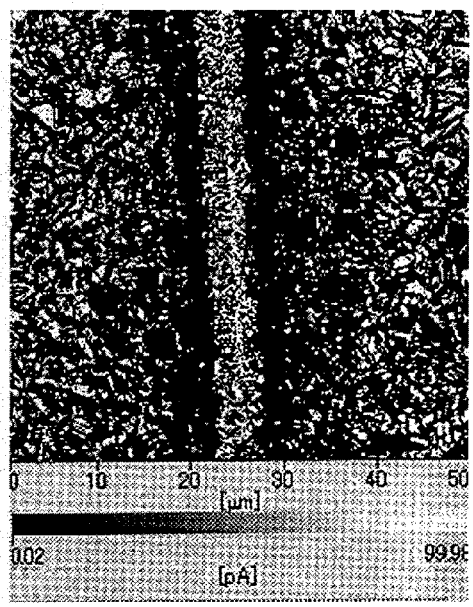
Figure 23A:
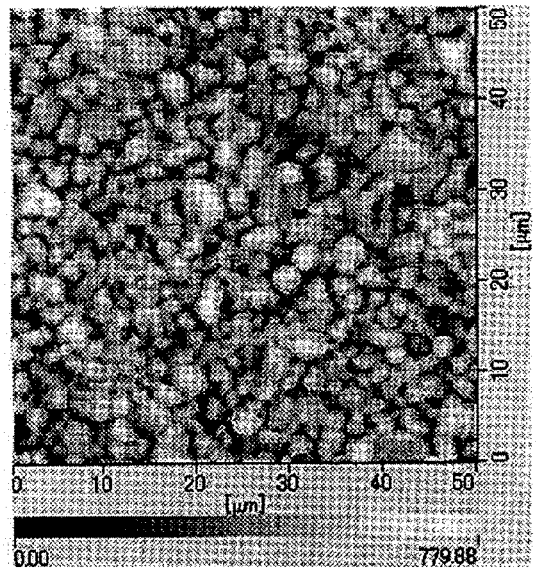
FIGS. 23(*a*) to 23(*b*) illustrates SIM images of sample 63 produced in Example 9.
Figure 23B:
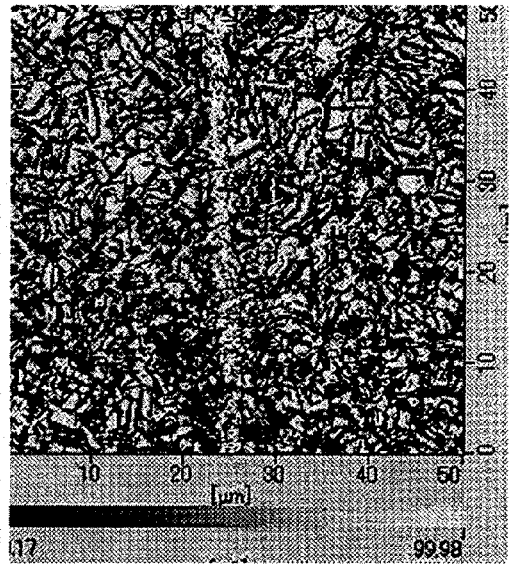

FIGS. 21(*a*) and (*b*) are SPM images of sample 61. FIGS. 22(*a*) and (*b*) are SPM images of sample 62. FIGS. 23(*a*) and (*b*) are SPM images of sample 63. In each of the figures, (*a*) is a surface shape image, and (*b*) is a current image.

For sample 62, the bright contrast current image of a laser-irradiated portion is obtained as illustrated in FIG. 22(*b*). Thus, the resistance is probably reduced. However, a laser energy density as high as 1.10 J/cm$^2$ caused ablation, forming a laser trace on the irradiated surface as illustrated in FIG. 22(*a*).

That is, it was found that in the case where a ceramic main body is irradiated with laser light with an energy density of 1.10 J/cm$^2$, although identification information can be recorded using a portion having a reduced resistance, the laser causes damage to a surface of the ceramic main body, impairing the surface shape.

For sample 63, as is apparent from FIG. 23(*a*), although a laser trace was not formed on the surface, the resistance of a laser-irradiated portion was not sufficiently reduced because of a laser energy density was low at 0.22 J/cm$^2$. Thus, it was found that it is difficult to distinguish between an irradiated portion and a non-irradiated portion as illustrated in FIG. 23(*b*), causing difficulty in writing and reading identification information.

In contrast, for sample 61, the laser energy density is 0.55 J/cm$^2$, which is in the preferred range of the present invention. Thus, as illustrated in FIG. 21(*a*), no laser trace is formed on the irradiated surface. Furthermore, as illustrated in FIG. 21(*b*), the bright contrast current image of a laser-irradiated portion is obtained. Thus, the resistance is probably reduced.

That is, it was found that for sample 61, it is possible to write and read identification information using a portion having a reduced resistance without damaging the surface due to laser irradiation.

Even if the ceramic grain size is changed, similar results are surely obtained.

The invention claimed is:

1. An NTC thermistor ceramic comprising:

a ceramic main body comprising a Mn-containing first phase and a second phase which has a higher resistance than the first phase, and a heated region on a surface of the ceramic main body, in which heated region the second phase is crystallographically equivalent to the first phase.

2. The NTC thermistor ceramic according to claim 1, wherein the second phase comprises Mn plate crystals and distributed in the first phase in a dispersed state.

3. The NTC thermistor ceramic according to claim 2, wherein the ceramic main body contains Mn and Ni, and the first phase has a spinel structure, and wherein the ratio, in atomic percent, of the Mn content to the Ni content of the entirely of the ceramic is in the range of 87/13 to 96/4.

4. The NTC thermistor ceramic according to claim 3, wherein the ceramic main body contains Cu.

5. The NTC thermistor ceramic according to claim 2, wherein the ceramic main body contains Mn and Co, and the first phase has a spinel structure, and wherein the ratio, in atomic percent, of the Mn content to the Co content of the entirely of the ceramic is in the range of 60/14 to 90/10.

6. The NTC thermistor ceramic according to claim 5, wherein the ceramic main body contains Cu.

7. The NTC thermistor ceramic according to claim 1, wherein the second phase not in the heated region has a higher Mn content than the first phase.

8. A method for producing an NTC thermistor ceramic comprising firing a green compact containing a Mn-containing raw-material to form a ceramic main body by a firing sequence of heating to a maximum firing temperature, maintaining the maximum firing temperature for a period of time and then cooling the ceramic main body so as to form a high-resistance second phase having a higher Mn content than a first phase, wherein the method further comprises after the firing sequence, subjecting a surface of the ceramic main body to heat to form a heated region which is crystallographically equivalent to the first phase.

9. The method for producing an NTC thermistor ceramic according to claim 8, wherein the second phase having a plate-like shape is formed so as to be dispersed in the first phase during the firing sequence.

10. The method for producing an NTC thermistor ceramic according to claim 8, wherein the application of heat to a surface of the ceramic main body is at a temperature above the temperatures in the firing sequence.

11. The method for producing an NTC thermistor ceramic according to claim 8, wherein the application of heat to a surface of the ceramic main body is effected with a pulsed laser.

12. The method for producing an NTC thermistor ceramic according to claim 11, wherein laser light emitted from the pulsed laser has an energy density of 0.3 to 1.0 $J/cm^2$.

13. An NTC thermistor comprising external electrodes formed on end portions of a ceramic body which comprises a ceramic according to claim 1, and wherein the heated region is disposed in a line-like shape on a surface of the ceramic body and connects a pair of external electrodes.

14. An NTC thermistor according to claim 1, wherein the heated region and external electrodes disposed in parallel.

15. An NTC thermistor comprising a ceramic body partitioned into a first body portion and a second body portion, a first external electrode and a second external electrode disposed at one end portion of the ceramic body, a third external electrode and a fourth external electrode disposed at the other end portion of the ceramic body so as to face the first external electrode and the second external electrode, respectively, wherein a first NTC thermistor portion comprises the first external electrode, the first body portion, and the third external electrode, and a second NTC thermistor portion comprises the second external electrode, the second body portion, and the fourth external electrode, and wherein the ceramic body is composed of the NTC thermistor ceramic according to claim 1, and the heated region having a predetermined linear pattern is disposed on a surface of one of the first NTC thermistor portion and the second NTC thermistor portion.

16. The NTC thermistor according to claim 12, wherein the heated region is disposed on a surface of the ceramic body so as to provide identification information.

17. An NTC thermistor comprising a ceramic body comprising the NTC thermistor ceramic according to claim 1, a plurality of external electrodes formed at different end portions of the ceramic body and spaced from one another at predetermined intervals, and a plurality of conductors on a surface of the ceramic body, wherein each of the plural conductors is electrically connected to a pair of the plural external electrodes disposed on different end portions of the ceramic body with a heated region disposed between a plurality of the connected external electrodes, wherein the plural heated regions are disposed at positions having different distances from one end portion of the ceramic body.

18. The NTC thermistor according to claim 16, wherein the conductors are metallic.

* * * * *